US005381880A

United States Patent [19]

Pearson

[11] Patent Number: 5,381,880

[45] Date of Patent: Jan. 17, 1995

[54] ELECTRONIC COIN MECHANISM

[76] Inventor: Rune S. Pearson, 2919 Avenue D, Katy, Tex. 77493

[21] Appl. No.: 973,825

[22] Filed: Nov. 9, 1992

[51] Int. Cl.[6] ..... G07F 11/04

[52] U.S. Cl. ..... 194/217; 194/334; 194/346

[58] Field of Search ..... 194/216, 217, 218, 219, 194/334, 337, 336, 338, 345, 346, 226, 227

[56] References Cited

U.S. PATENT DOCUMENTS

| | | | |
|---|---|---|---|
| 2,129,322 | 9/1938 | Hakanson | 221/243 |
| 3,680,566 | 8/1972 | Tanaka et al. | 453/4 |
| 3,739,895 | 6/1973 | Fougere . | |
| 3,918,565 | 11/1975 | Fougere . | |
| 4,089,400 | 5/1978 | Gregory . | |
| 4,267,916 | 5/1981 | Black . | |
| 4,275,806 | 6/1981 | Tanaka . | |
| 4,509,633 | 4/1985 | Chow | 194/334 |
| 4,585,936 | 4/1986 | Sellier | 194/334 X |
| 4,646,904 | 3/1987 | Hoormann | 194/334 |
| 4,667,093 | 5/1987 | MacDonald | 194/334 X |
| 4,845,484 | 7/1989 | Ellsberg | 221/154 |
| 4,848,556 | 7/1989 | Shah | 194/212 |
| 5,033,603 | 7/1991 | Kai | 194/334 |
| 5,036,966 | 8/1991 | Kaspar et al. | 194/217 |
| 5,201,396 | 4/1993 | Chalabian et al. | 194/217 |

*Primary Examiner*—F. J. Bartuska
*Attorney, Agent, or Firm*—Conley, Rose & Tayon

[57] ABSTRACT

An electro-mechanical coin totalizer for newspaper vending machines and the like includes a coin chute having an arcuate shoulder, a wake-up arm, and optical sensors for measuring a chord length on coins inserted in the totalizer. A coin inserted in the coin chute travels along the arcuate shoulder, whereby coin bounce is minimized and the accuracy of coin chord measurements is enhanced. The wake-up arm biases coins against the arcuate shoulder and reduces coin bounce in direct proportion to the size of the coin.

21 Claims, 14 Drawing Sheets

ELECTRONIC COIN MECHANISM

BACKGROUND OF THE INVENTION

The present invention relates generally to newspaper vending racks, and more particularly to a microprocessor-controlled coin mechanism allowing the customer to open the vending rack door on payment of the appropriate price of the newspaper.

Newspaper vending racks over the last 20 to 30 years have relied primarily on a simple coin totalizer mechanism that measured the height of a stack of coins within a coin chute to determine whether to release the door of a newspaper vending rack. Because of the number of different combinations of different coins that can be used to accumulate a particular price, and because a measurement of the stacked height gives only limited discrimination between various combinations, the allowable coin combinations for this type of mechanism normally are limited to one or two variations. A 25-cent newspaper, for example, typically can be purchased from this prior art mechanism by inserting a quarter in one of two slots or five nickels in the other slot.

The coin height method sufficed when the price of newspapers was low and depended on only a few coin combinations. However, as newspaper prices have increased, the number of coin combinations available to reach a particular price has increased as well. For instance, there are 10 different possible combinations of nickels, dimes and quarters that total 50 cents. A typical coin height mechanism, however, permits only two different coin combinations, for example, five dimes or two quarters. Thus, as the price increases, the limited flexibility of the coin height mechanism causes greater inconvenience to the purchaser and excludes more and more purchases. A customer with one quarter, two dimes, and a nickel would be unable to purchase a newspaper due to the restrictive nature of the mechanism.

The coin height determination method becomes much more complex and more likely to malfunction when applied to more than two or three coin combinations. It can readily be seen that as newspaper prices get into the 50-cent to 75-cent range for daily editions and $1.25 to $2.50 range for Sunday editions, the stackable coin height mechanism with only two or three allowable coin combinations severely limits a customer's chances of having the combination of coins required to purchase a paper.

There exist improved, fully mechanical coin totalizer mechanisms that allow the use of any combination of nickels, dimes, or quarters to achieve a particular vend price. Because of the greater complexity of such mechanisms, however, they cannot be adapted for use in existing newspaper racks that were developed for simpler coin totalizer mechanisms. The majority of newspaper racks currently in use were designed for a stackable coin height mechanism, as previously described. Although some of the older, existing racks can be adapted to handle the newer, larger mechanical totalizer, the cost of the adaptation is quite significant. Other racks cannot be adapted to the larger mechanical mechanisms and would have to be replaced with entirely new racks.

Also, these more complex mechanical totalizer mechanisms, as currently configured, have some internal limitations as to maximum prices as well as to the allowable spread between daily and Sunday papers. In some cases these limitations can be overcome with adapter kits. However, these are relatively costly and add to the mechanical complexity of the units.

Fully mechanical coin totalizer mechanisms have the further deficiency of frequent malfunctions due to the large number of component parts required in such mechanisms. In addition, because most newspaper vending racks are exposed to the outdoor environment, the mechanism must function in greatly varying weather and contamination conditions. Further, mechanical coin totalizer mechanisms are dedicated to the use of existing United States coins and cannot be adapted readily to new U.S. coins, foreign coins, or tokens.

In addition to existing fully mechanical coin mechanisms, several attempts have been made to develop an electro-mechanical coin mechanism that is controlled by a microprocessor. The Bellatrix Company of Oregon, for example, manufactures a microprocessor-controlled, electro-mechanical coin mechanism that is battery powered and that will operate for one or more years on one set of batteries. The Bellatrix coin mechanism includes a coin slot with internal straight sides to guide coins past four optical sensors. The sensors send signals to a microprocessor, which determines the value of the coin inserted into the newspaper rack. The Bellatrix mechanism, however, can recognize only the current U.S. dime, nickel, and quarter. It cannot be adapted readily to recognize foreign coins or any new U.S. coins that may be minted in the future. Further, the Bellatrix microprocessor-controlled coin mechanism requires a separate hand-held controller to select the vend price as the Sunday price or the daily sale price. This controller communicates with the coin mechanism by infrared optics. Infrared controllers are undesirable due to their frequent failure and difficulty of use.

Electro-mechanical coin mechanisms, such as the mechanism disclosed in U.S. Pat. No. 4,509,633, are particularly sensitive to vibration and bounce in the coin as it travels through the mechanism. Because the manual insertion force cannot be controlled, coins may enter the mechanism at high or low velocity and may bounce around within the mechanism, rendering optical measurements on the coin inaccurate.

Kaspar Wire Works manufactures an electronic coin mechanism similar to the Bellatrix mechanism. The Kaspar mechanism is too large to fit within the current confines of the simpler mechanical coin mechanism and hence requires at least a costly rack conversion.

Still another problem with prior art coin mechanisms used for newspaper vending racks relates to the rigid locking means for preventing a coin return action when door is open. Typically, after the door has been released for opening in response to the insertion of the vend price, the coin return mechanism is locked out, preventing the customer from obtaining a return of the coins should he or she thereafter decide not to purchase the newspaper. In addition, the mechanism for locking out the coin return simply latches the mechanism rigidly in place without disabling the coin return button. Thus, force applied to the coin return button by a disgruntled purchaser is translated directly to the mechanism, causing wear and frequent damage to the mechanism.

Similarly, customers frequently allow the door on a rack to close itself, in which event the heavy spring on the rack door causes the door tongue to slam into the coin mechanism with considerable force. Over time, this causes wear and premature failure of the coin mechanism.

Thus, it would be desirable to provide a reliable microprocessor-controlled coin mechanism that is capable of accepting any combination of U.S. or foreign coins or tokens, that can be adapted easily to accommodate coins that may be minted in the future, and that is adapted physically for use in existing newspaper racks that employ a mechanical coin height mechanism, as described above. It would also be desirable to provide a coin mechanism that is well adapted for the normal use and abuse experienced by coin mechanisms in newspaper racks.

SUMMARY OF THE INVENTION

Accordingly, there is provided herein an apparatus for totalizing coins that includes a means for receiving the coins, a means for sensing a coin within the receiving means, and a means for determining the denomination of a coin detected by the sensing means. Preferably, the receiving means defines an arcuate shoulder or path followed by the coin as it passes through the sensing means.

The arcuate shoulder may include an upper arc portion and a lower arc portion. The upper arc portion is at least partially above a coin inserted into the receiving means. The lower arc portion at least partially supports the coin as it moves along the path through the receiving means.

The coin mechanism also may include a means for conducting the coin to and holding it against the arcuate shoulder so as to obtain a more accurate measurement from the sensing means. The conducting means may be a body rotatable about a shaft, with a projection that extends toward the arcuate shoulder and that rotates downward in response to contact with a coin, thereby permitting passage of the coin between the projection and the arcuate shoulder.

The conducting means preferably is oriented with respect to the arcuate shoulder such that the upper arc converges on the projection to trap a coin therebetween. Significantly, the point at which the coin contacts the upper surface of the projection is a distance from the shaft of the conducting means that varies inversely with the diameter of the coin. By forcing larger coins to contact the projection closer to the shaft, the arcuate shoulder results in a relatively constant moment of inertia applied by coins of various diameters against the conducting means and thereby establishes a relatively constant velocity for all coins through the receiving means. The conducting means also helps to dampen coin bounce, applying a greater dampening action, because of the relative position of the arcuate shoulder, to larger coins that have a greater mass. It is an important object of the present invention to provide an improved means for debouncing coins in advance of the coins passing by the sensing means, whereby the accuracy and reliability of measurements on the coins is significantly enhanced.

The conducting means also preferably includes a counterweight that opposes downward rotation of the projection, so that the projection biases the coin against the arcuate shoulder. The projection preferably maintains contact with the coin against the lower arc portion of the arcuate shoulder at least until the coin passes into the detecting means, thereby assuring a smooth motion into the detecting means and consequently a more accurate measurement on the coin. The magnitude of the arc defined by rotation of the conducting means projection varies directly with the diameter of the coin, so that larger coins with greater mass are biased against the lower arc portion by the projection for a greater distance along the arcuate shoulder.

The sensing means preferably is an optical detecting means comprising a pair of optical sensors that detect the passing of a leading and a trailing edge of a coin. The determining means preferably is a microprocessor that calculates, based on measurements from the sensing means and a known distance between the sensors, a velocity for the coin traveling through the receiving means and a time period for passage of the coin. Based on this information, the microprocessor calculates a chord measurement on the coin. By comparing the calculated chord length with values stored in a memory, the microprocessor can identify the denomination of the coin.

The dimensions of the present invention allow its installation within the highly restricted dimensional limitations of the prior art mechanical racks, while still accomplishing all of the customer-required functions. The dimensional limitations relate to the position of the coin entry slot, the coin return button, the coin return chute, the tongue on the access door to the rack, and internal clearance requirements. The present invention performs all the functions of fully mechanical prior art totalizers and existing electronically-controlled coin mechanisms, without their inherent limitations.

Other significant aspects and advantages of the coin totalizer of the present invention include power provided by a lithium battery having a life of many years; a low battery power detector that checks the battery voltage each time the rack is refilled with newspapers and audibly alerts the rack service person if the battery is getting low; three independent price settings for daily, Sunday and special edition newspapers, with each price selectable up to a maximum price of $6.35 in 5-cent increments; accepts coin values of $.05, $.10, $.25, and the U.S. Susan B. Anthony dollar coin; recognizes a special slug that is used by a service person to open the rack regardless of the price setting; special tokens may be used for promotional campaigns; a door latching means to allows a customer to get money back even after the full vend price has been inserted into the totalizer, up to the point where the door is opened; however, once the door has been opened, the coins immediately fall into a collection box, and the coin return button is disabled; the totalizer is easily disassembled for cleaning; coins that are dimensionally beyond a software-defined range are rejected; ferrous coins are rejected if the option is hardware-selected; slugs with holes are automatically rejected; a serial input/output port permits reprogramming of the coin mechanism for new coin sizes and changing software selectable data; the mechanism can be programmed to allow coin values to be changed and to accept foreign coins; the coin mechanism can be retrofitted into all vending racks that utilize the simpler stackable coin type mechanism with little or no modifications; the operating program and memory-resident variables do not require constant battery power; the vend price can be changed to the daily, Sunday or special setting by a key activated lock on the front of rack; and the coin return button has internal torque limiting means to prevent damage to the coin mechanism if customer applies severe force to the coin return button.

These and various other objects and advantages of the present invention will become readily apparent to those skilled in the art upon reading the following detailed description and claims and by referring to the accompanying drawings.

BRIEF DESCRIPTION OF THE DRAWINGS

For a detailed description of the preferred embodiment of the invention, reference will now be made to the accompanying drawings, wherein.

DETAILED DESCRIPTION OF THE PREFERRED EMBODIMENT

Mechanical coin totalizer mechanisms used in existing newspaper vending racks typically measure the height of a stack of coins to determine whether to release a rack door. The coin combinations accepted by such mechanisms are limited to two or three predefined combinations, such as one quarter or five nickels. As the price of a newspaper increases, the inconvenience and inflexibility of these fully mechanical totalizer mechanisms causes a loss of newspaper sales.

Existing electro-mechanical totalizer mechanisms accept a more varied selection of coins, but cannot be adapted for use in existing racks without relatively costly changes in the rack. In addition, some such mechanisms have a relatively high error rate due to coin bounce within the mechanism, require external programming means to change the effective price of the newspaper, and do not accept foreign coins, such as Canadian coins, or tokens.

The present invention is directed to a highly accurate electro-mechanical coin totalizer mechanism that can accept any combination of U.S. or foreign coins, or a token, does not require an external programming means to change price, and can be fitted within existing newspaper racks in place of the mechanical coin height mechanism without modifying the rack. As used herein, "coin" refers also to tokens.

Figure 1:
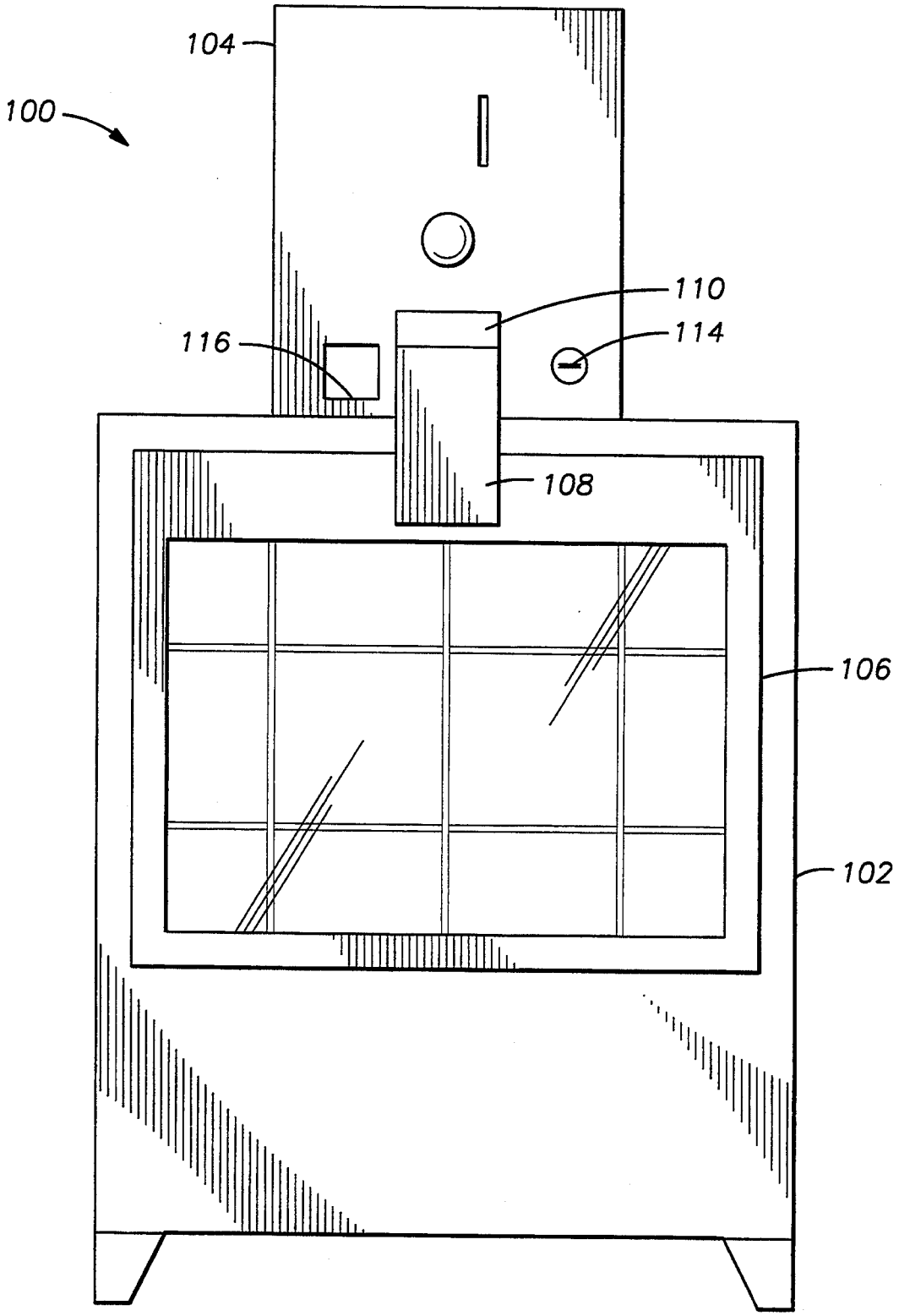
FIG. 1 shows in front elevation a typical vending rack of which a coin mechanism constructed according to the principles of the present invention may form a part.

Referring now to FIG. 1, there is shown a newspaper vending rack 1 00 of the type in general use at the present time. The rack 100 includes an enclosure 102 for the newspapers and a housing 104 fixedly mounted thereon for supporting therewithin an electronic coin mechanism constructed in accordance with the principles of the present invention. The enclosure 102 includes an access door 106 for loading and dispensing newspapers therethrough. The paper access door 106 further includes a door extension 108 with a door handle 110. Housing 104 is a substantially rectangular, sheet metal structure to an upper surface of the newspaper vending rack 100. While the preferred embodiment of the inventive coin totalizer mechanism is described with specific reference to a newspaper vending rack, it will be evident to those with skill in the art of coin totalizer mechanisms that the present invention is not limited to application on newspaper vending racks and may be used in any of a variety of other coin-operated vending machines.

GENERAL STRUCTURE AND METHOD OF OPERATION

Figure 2A:
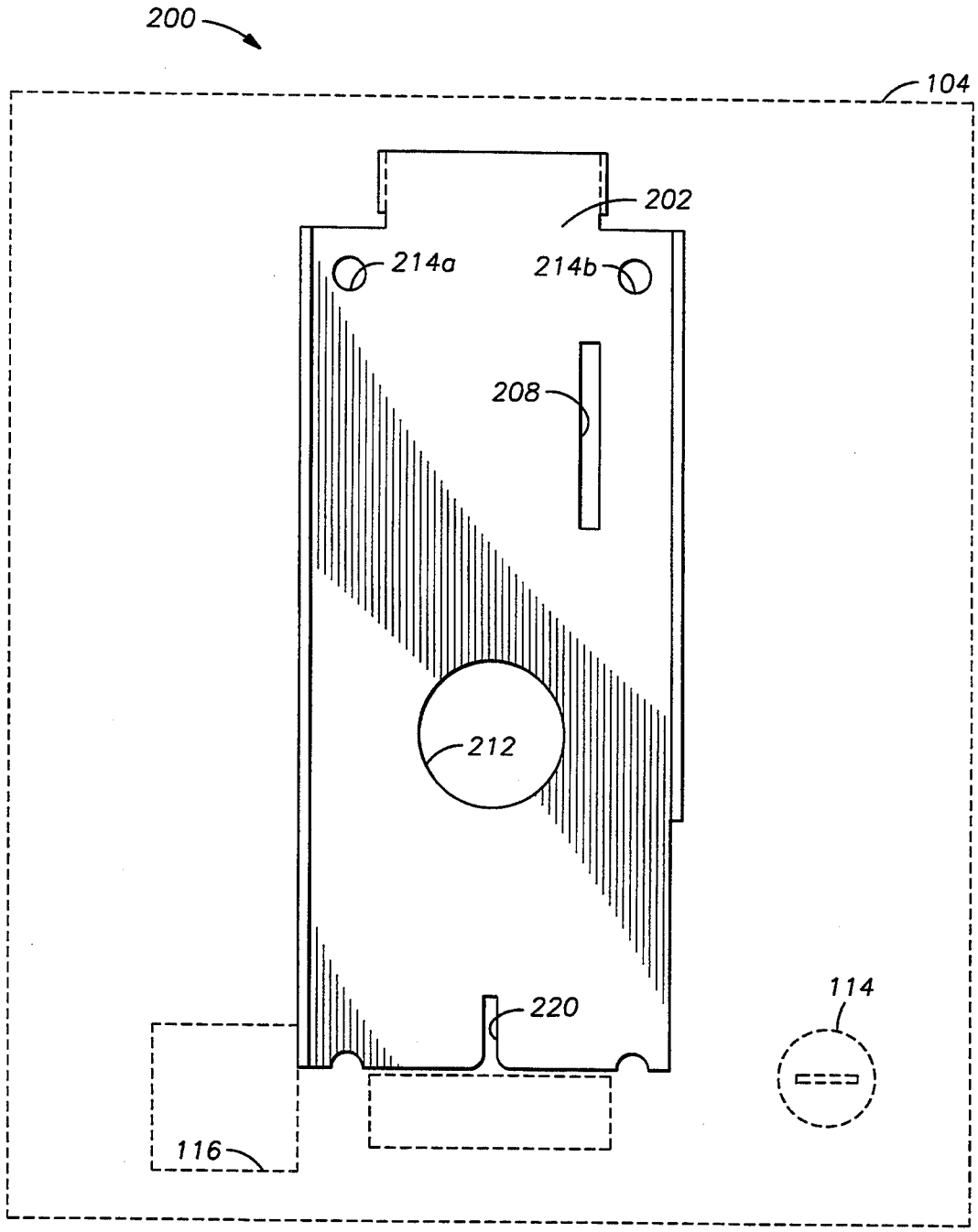
FIG. 2A depicts the coin mechanism of the present invention in front elevation, with a portion of the rack in FIG. 1 depicted in phantom to demonstrate the manner in which the inventive coin mechanism connects with the existing rack.
Figure 2B:
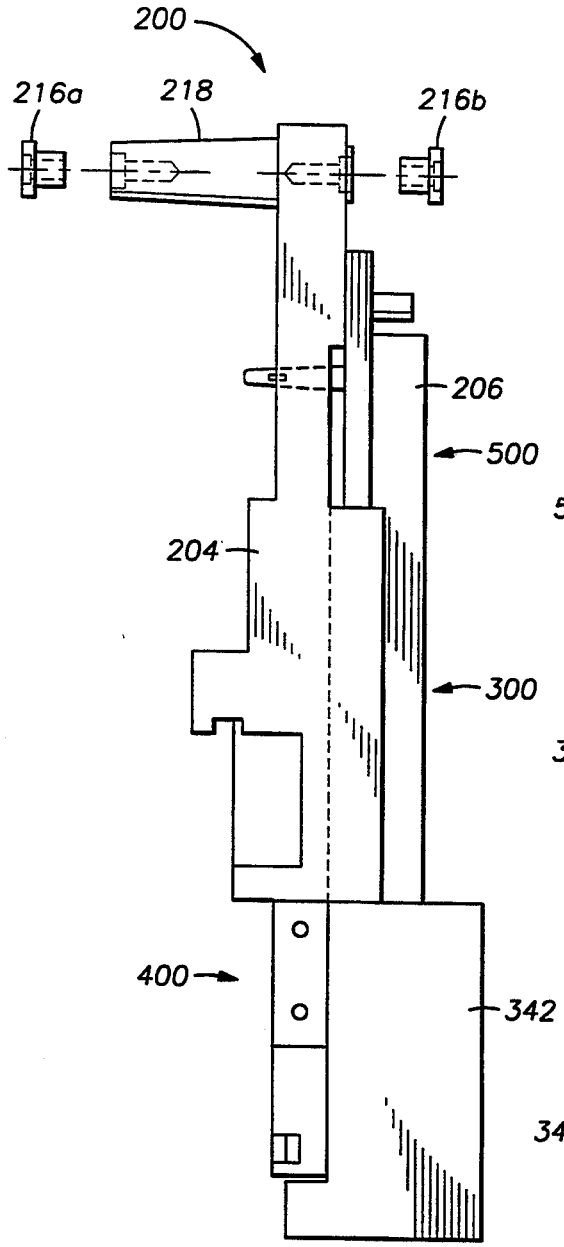
FIG. 2B depicts the coin mechanism of FIG. 2A in front elevation, with a base plate removed to reveal the working portions of the mechanism.
Figure 2C:
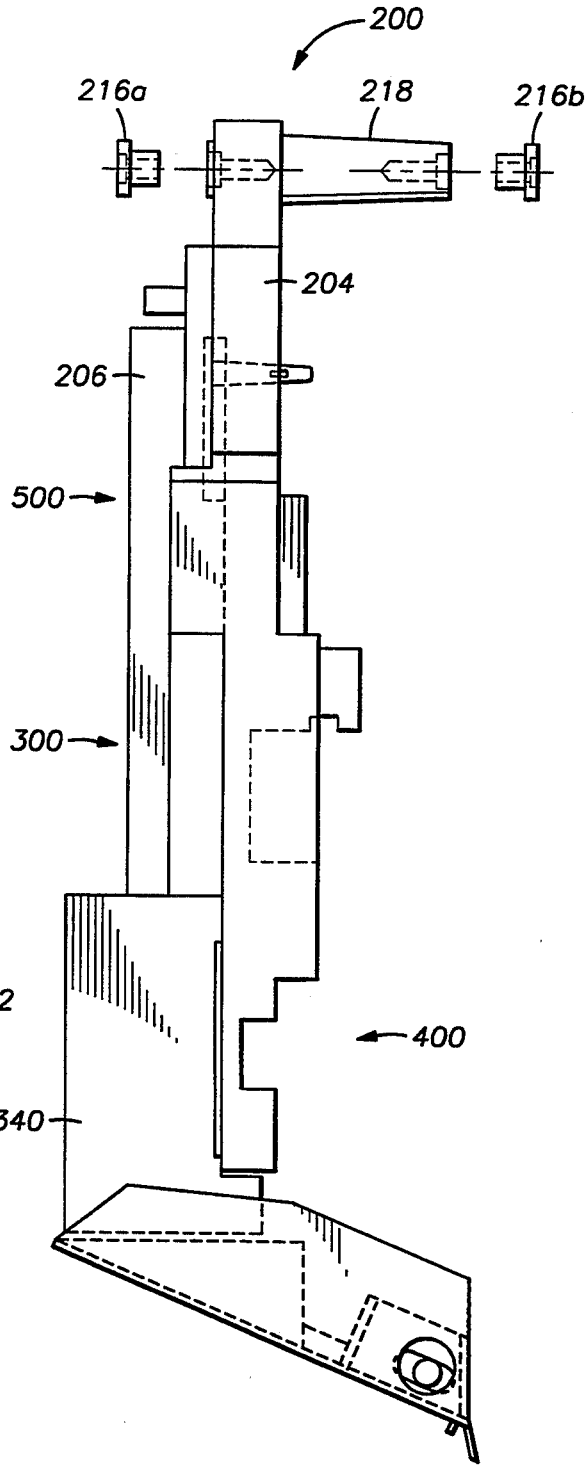
FIG. 2C depicts the coin mechanism of FIG. 2A in rear elevation.

Referring now to FIGS. 2A, 2B, and 2C, an electromechanical coin totalizer mechanism 200 constructed in accordance with the principles of the present invention preferably comprises a base plate 202, a main body 204, a right side cover 206, a coin chute assembly 300, a coin delivery assembly 400, and a control system 500.

The base plate 202 is a generally flat metal plate mounted within and forming a part of existing newspaper racks. It includes a slot 208 for receiving coins therethrough and a circular hole 212 for a coin return button. A pair of holes 21 4*a,b* in the upper end of the base plate receive a pair of alignment pins (not shown) in the housing 104 to align the base plate 202 properly within the housing 104, whereby the electronic coin mechanism 200 will connect to the existing housing 104 so as to enable use of the electronic coin mechanism 200 within existing newspaper racks.

The main body 204 supports or forms a part of the remaining portions of the coin mechanism 200. It comprises a part injection molded of plastic in a configuration that is described in detail below. The plastic used in molding the main body 204 preferably is polycarbonate. Other parts injection molded of plastic, as described below, preferably are constructed of the same or a compatible material.

The main body 204 is pivotally connected at its upper end to the base plate 202 by means of a pair pivot rod locking pins 21 6a,b received through a pair of flanges (not shown) projecting perpendicularly inwardly from the base plate 202 and into a pivot rod 218 on the main body 202. The locking pins 216a,b are fixedly secured within the rod 218 so as to allow pivotal motion of the main body 204 relative to the base plate 202.

Figure 10A:
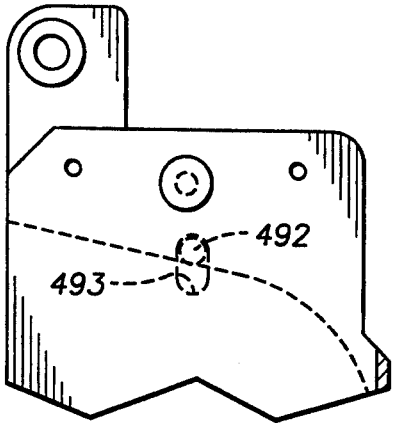
FIGS. 10A–E are partial right side, rear, left side, rear, and left side elevational views, respectively, of the coin mechanism of FIG. 2A showing a coin clearing mechanism.
Figure 10B:
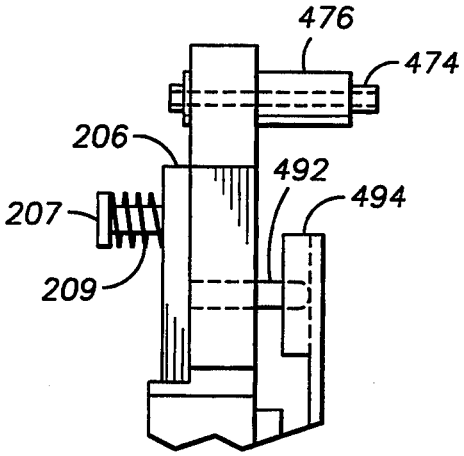
Figure 10C:
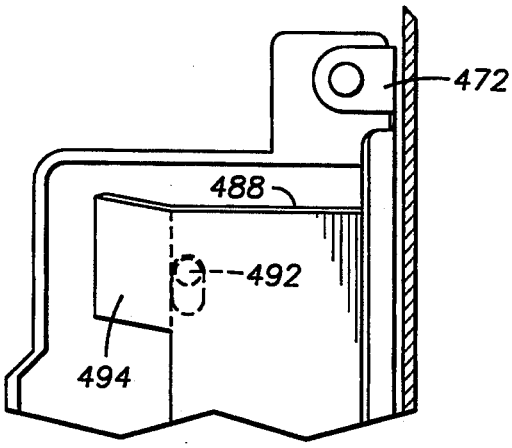
Figure 10D:
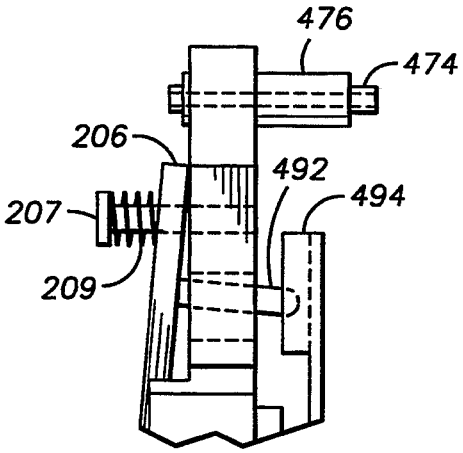
Figure 10E:
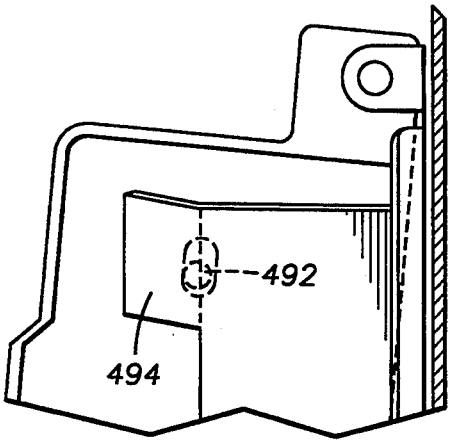

The right side cover 206 comprises a part injection molded of plastic in a configuration that is described in detail below. Referring briefly to FIGS. 10B and 10D, the side cover 206 is attached to the upper end of the main body 204 by means of a bolt 207, with a spring 209 between the head of the bolt and the right face of the right side cover 206, whereby the side cover 206 can pivot laterally away from the main body 204. Together with the main body 204, the right side cover 206 defines a path followed by coins inserted into the mechanism 200 and supports the coin chute assembly 300 and the coin delivery assembly 400.

The coin chute assembly 300 comprises those portions of the mechanism 200 that enable the mechanism 200 to receive coins, discriminate their value, and escrow them for further processing. The coin delivery assembly 400 comprises those portions of the mechanism 200 that enables the mechanism 200 to release the door of the newspaper rack when the correct combination of coins have been inserted in the mechanism. The coin delivery assembly 400 also comprises those portions of the mechanism that deliver escrowed coins either to a collection compartment or a coin return chute, depending on the circumstances. The control system comprises a microprocessor-based controller and related electronic components that process signals received from the coin chute assembly 300 and pass signals to the coin delivery assembly 400 to release the rack door as appropriate. The coin chute assembly 300, the coin delivery assembly 400 and the control system 500 each are described in detail below.

An overview of the method of operation of the mechanism 200 commences on the receipt of a coin through the coin chute 208. The coin follows a defined path through the coin chute assembly 300, passing in front of a pair of optical sensors (not shown) and coming to rest within an escrow compartment (not shown). Based on signals received from the optical sensors, the microprocessor measures certain time periods, computes the velocity of the coin within the mechanism, and thereby computes the length of a chord on the coin, as described in U.S. Pat. No. 4,509,633 issued to Chow, which is hereby incorporated by reference herein. By comparing the calculated chord length with a table of lengths stored within the control system 500, the microprocessor determines the value of the coin. When the value of the escrowed coins meets or exceeds the price of a newspaper, the door on the newspaper rack is released, and the escrowed coins are delivered to a collection compartment (not shown). If, alternatively, the coin return button is pushed, the escrowed coins are delivered to a coin return chute (116 in FIG. 1), the control system is reset, and the rack door remains locked.

THE COIN CHUTE ASSEMBLY

Figure 3:
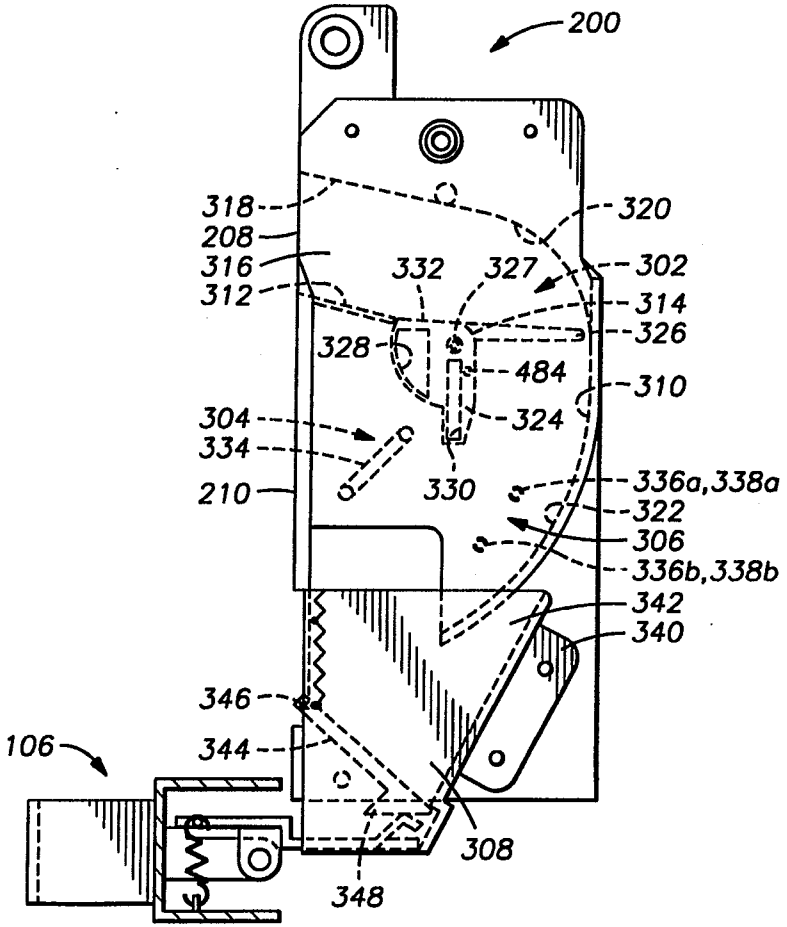
FIG. 3 shows a door tongue on the rack of FIG. 1 and the coin mechanism of FIG. 2A in right side elevation, with phantom lines depicting a coin flow path and a coin escrow compartment within the coin mechanism.
Figure 7:
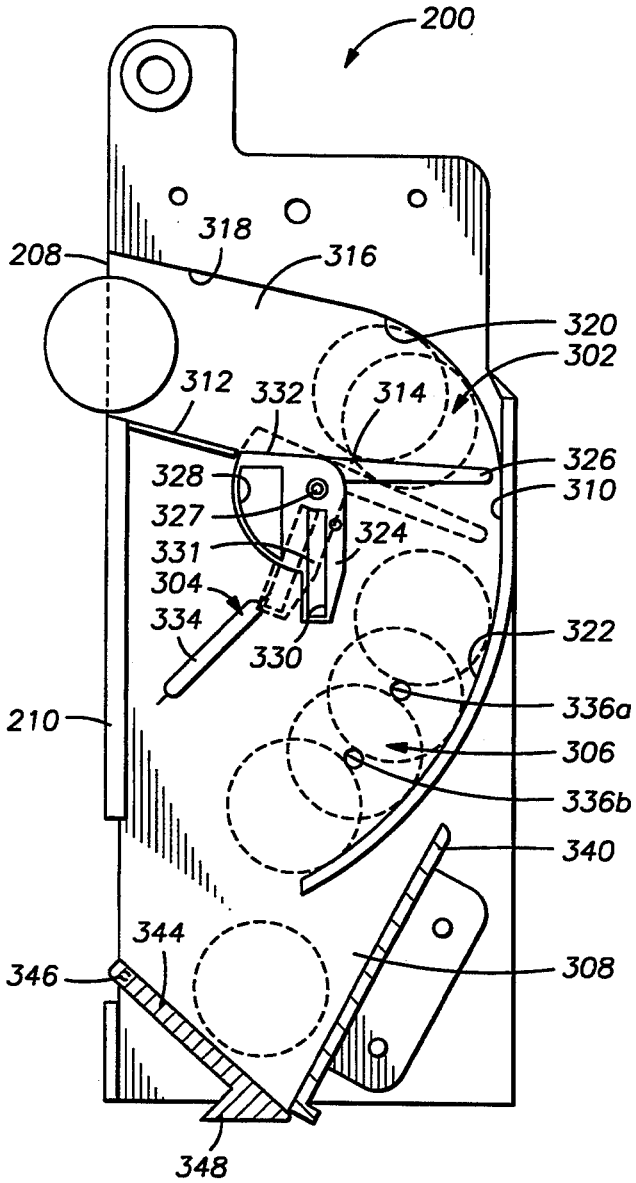
FIG. 7 is a right-side elevational view of the coin mechanism of FIG. 2A, with part of the mechanism disassembled to reveal the coin path and the variable counter-weight means, showing a coin passing along the coin path.

FIGS. 3 and 7 show the mechanism 200 in right side elevation. FIG. 3 depicts in phantom portions of the right face of the main body 204 and portions of the apparatus lying between the main body 204 and the right side cover 206. In FIG. 7, the right side cover 206 has been removed to expose the right face of the main body 204. The coin chute assembly 300 comprises a coin chute 302, a wake-up system 304, an optical detector system 306, and a coin escrow compartment 308.

The Coin Chute

Referring now to FIGS. 3 and 7, the coin chute 302 defines the path traversed by a coin from its entrance into the mechanism 200 until it reaches the escrow compartment. The coin chute 302 comprises an arcuate shoulder 310 and a support shoulder 312 in the main body 204, a pivotal wake-up arm 314 affixed to the main body 204, and an adjoining wall of the right side cover 206. The shoulders 310, 312 are machined in the main body 204 to define therebetween a lateral recess 316 that forms a path for coins entering the mechanism 200. The width of the shoulders 310, 312 preferably is approximately 2.5 min. The distance between the shoulders 310, 312 at the coin slot 208 in the base plate (not shown) preferably is approximately 2.9 cm. These dimensions permit the mechanism 200 to accept current U.S. and foreign coins and coins that may reasonably be minted in the future and without exposing the mechanism 200 unduly to vandalism by insertion of materials other than coins.

The arcuate shoulder 310 projects linearly rearwardly, as indicated at 318, for approximately 5 cm. from the front face 210 of the main body 204 at a downward angle of approximately 12 degrees relative to a line perpendicular to the front face 210. The shoulder 310 then curves through an input arc 320 on a radius of curvature of approximately 3.2 cm. for approximately 76 degrees. Below the input arc 320, the radius of curvature of the shoulder 310 changes to approximately 7.3 cm. for approximately 58 degrees in a sensor arc 322. The shoulder 310 ends approximately 3.5 cm. from the front face 210.

The input arc 320 and the sensor arc 322 are important aspects of the present invention. Typical prior art coin mechanisms employ a simple incline to channel coins through particular points on the mechanism. Coins passing along the incline tend to bounce and vibrate, which renders sensitive measurements on the coins, such as optical measurements, inaccurate. The arcuate shoulder 310 captures the coins as they enter the coin chute and smoothly moves them along the coin path and past the optical sensors, as discussed below, with a minimum of bounce.

The support shoulder 312 projects linearly rearwardly for approximately 2.5 cm. from the front face 210 of the main body 204 along a line generally parallel to the linear portion 318 of the arcuate shoulder 310.

The wake-up arm 314 comprises a member injection molded of plastic to form a body 324 and a linear projection 326. The body 324 includes a counterweight recess 328 for supporting a counterweight and a magnet recess 330 for supporting a permanent magnet 331. In the preferred embodiment, the counterweight weighs approximately 12 grams and the magnet weighs approximately 4 grams.

The arm 314 is pivotally attached by means of a shaft 327 secured to the main body 204 and balanced by appropriate choice of the counterweight and magnet such that when no coin is in contact with the arm 314, the upper surface 332 of the body 324 is generally horizontal and generally continuous with the lower end of the support shoulder 312. The linear projection 326 extends linearly from the body 324 approximately 2.5 cm along a line defined by the upper surface 332 of the body 324. The upper surface 332 is approximately 2 cm. long.

The face of the right side cover 206 adjoining the main body 204 is generally flat with the following exceptions. First, the adjoining face includes a recess (not shown) that conforms to the configuration of the wake-up arm 314 and the path defined by its pivotal motion, whereby the cover 206 can fit parallel with and against the main body 204. Second, the adjoining face of the cover 206 includes a pair of grooves (not shown) approximately 0.5 mm. deep and 8 mm. wide extending side-by-side along the path traversed by a coin. The pair of grooves, along with matching grooves (not shown) in the adjacent surface of the recess 316 in the main body 204, prevent a coin from pulling a vacuum and locking to the main body 204 or the right side cover 206 within the coin chute 302 when moisture is present.

The Wake-Up System

Referring still to FIGS. 3 and 7, the wake-up system 304 comprises the wake-up arm 314 and a wake-up reed switch 334, the combination of which generates a signal to the microprocessor in the control system (not shown) on motion of the wake-up arm 314 relative to the right side cover 206. As described above, the wake-up arm 314 includes a magnet recess 330 for supporting a permanent magnet 331.

The reed switch 334 may be, for example, a device no. FR250545-053500 available from C.P. Clare, or a device having similar characteristics. The switch 334 is positioned generally as indicated on FIGS. 3 and 7 on a circuit board (not shown), which is attached to the outer face of the right side cover 206. Motion of the wake-up arm 314 relative to the right side cover 206 causes the magnet on the wake-up arm 314 to create a magnetic field surrounding the reed switch. The magnet closes the reed switch 334, generating a signal that is communicated to the microprocessor, which then prepares for receipt of a coin through the optical detector system 306.

The Optical Detector System

Referring still to FIGS. 3 and 7, the optical detector system 306 comprises a pair of infrared light sources 336*a,b* positioned in the main body 204 and a pair of optical sensors 338*a,b* positioned in the right side cover 206. The light sources 336*a,b*, which may comprise, for example, device no. OP165D made by Optron, are mounted on a circuit board (not shown) on the left face of the main body 204 so as to project light in the infrared frequency through a pair of small holes bored through the main body 204 at the points indicated for sources 336*a,b*.

The optical detectors, which may be, for example, device no. OP505A made by Optron, are mounted on a printed circuit board (not shown) on the right face of the right side cover 206 in alignment with small holes bored through the right side cover at the points indicated in FIG. 3 for detectors 338*a,b*. The two pairs of small holes in the main body 204 and the right side cover 206 are aligned with one another whereby infrared light projected from the sources 336*a,b* passes through the main body holes, across the coin path in the coin chute 302, and through the side cover holes to the detectors 338*a,b*.

When an object passes the light beam projected from a source 336*a,b*, the corresponding detector 338*a,b* transmits a signal to the microprocessor within the control system (not shown) at the leading and trailing edges of the object. Thus, the microprocessor can measure the time required for a coin to pass across a single detector 338*a,b* and the time required for a coin to pass between the two detectors 338*a,b*. Based on this information, the microprocessor can calculate the velocity of the coin and thereby can calculate a chord length for the coin.

Coin Escrow Compartment

Referring now to FIGS. 2A, 2B, 3, and 7, the coin escrow compartment 308 is the area at the lower end of the coin chute 302 where coins collect until the rack door 106 is opened or until the coin return button is depressed. The escrow compartment 308 comprises a guide plate 340, an enclosure plate 342, and a compartment door 344.

The guide plate 340 comprises a sheet metal plate having a perpendicularly extending flange that is fixedly secured to the right face of the main body 204, whereby the guide plate extends perpendicularly from the right face of the main body 204. As indicated in FIG. 7, the guide plate 340 directs coins received in the escrow compartment against the compartment door 344. The guide plate 340 supports on the forwardly facing surface thereof (interior of the compartment 308) a plate formed of plastic that forms a stop for the spring biased door 344, as described below.

The enclosure plate 342 comprises a generally L-shaped sheet metal plate that forms the right face and the front face of the compartment 308. The enclosure plate 342 is fixedly secured to the main body 204 at the front face thereof.

The compartment door 344 comprises a plate formed of plastic pivotally secured at the upper end thereof along a pin 346 between the enclosure plate 342 and the main body 204. The door 344 includes along the left edge thereof a downwardly extending flange 348 that is engaged by a member extending from the newspaper rack door, whereby the rack door, when closed, holds the compartment door 344 in the closed position, maintaining escrowed coins within the compartment 308.

Figure 17:
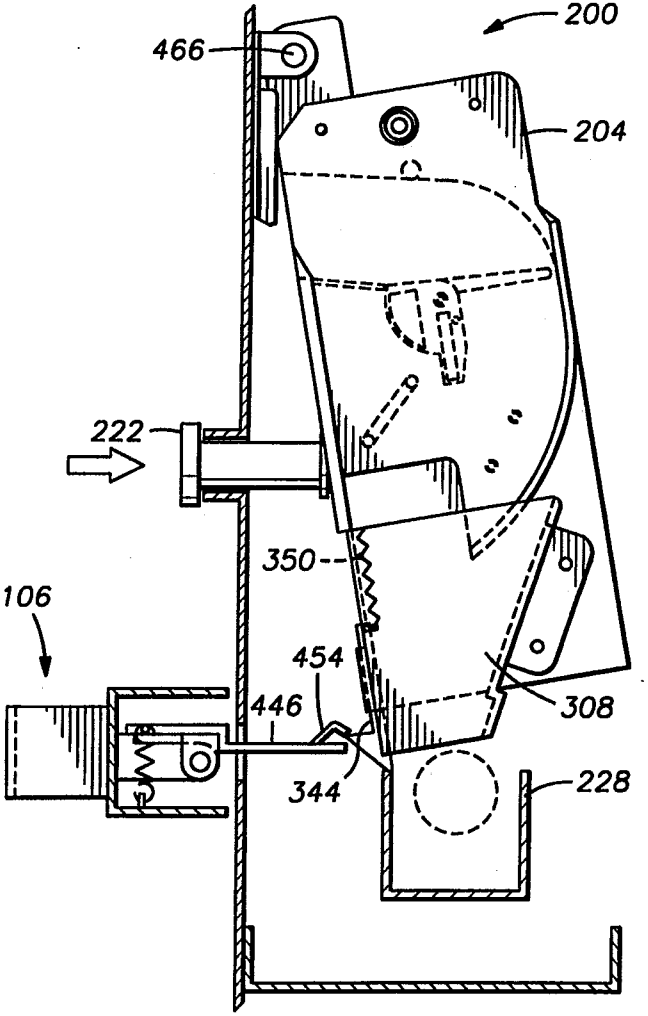

Referring now to FIG. 17, the compartment door 344 further includes an extension spring 350 biasing the door lightly to the closed position. The load of a single dime bearing against the upper surface of the door 344 is sufficient to overcome the bias of the spring 350, but the spring bias is sufficient to maintain the door 344 in the closed position, with a small clearance between the door 344 and the door tongue, as described below, when the compartment 308 is empty. Thus, closure of the rack door with excessive force, which occurs with some frequency, does not cause undue wear and premature failure of the compartment door 344.

Operation of the Coin Chute Assembly

Referring now to FIGS. 4A, 4B, 5A, 5B, 6A, and 6B, because the velocity of coins inserted in the coin chute 302 will vary depending upon the way the customer inserts the coins, the coin mechanism 200 first reduces the velocity of each coin. The wake-up arm 314 rotates in a clockwise direction around the shaft 327 as it is contacted by an incoming coin. The counterweight and permanent magnet on the wake-up arm 314 positioned forwardly of the shaft 327 resists this clockwise movement.

As is evident from FIGS. 4, 5, and 6, coins of varying dimensions contact the upper surface 332 of the wake-up arm 314 at differing distances from the shaft 327. A dime, for example, having the smallest diameter and the least weight contacts the wake-up arm upper surface 332 farthest from the shaft 327. Thus, the coin with the least amount of mass must overcome the least amount of counterweight force in order to rotate the wake-up arm 314. Also, the coin with the least amount of mass requires the least amount of velocity reduction and de-bouncing.

Figure 4A:
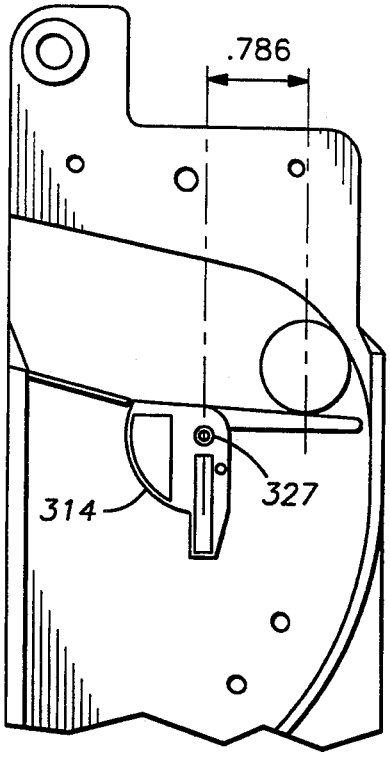
FIGS. 4A, 4B, 5A, 5B, 6A, and 6B are partial elevational views of the right side of the coin mechanism of FIG. 2A, with part of the mechanism disassembled to reveal a coin path and a variable counter-weight means for coins of differing diameters.
Figure 4B:
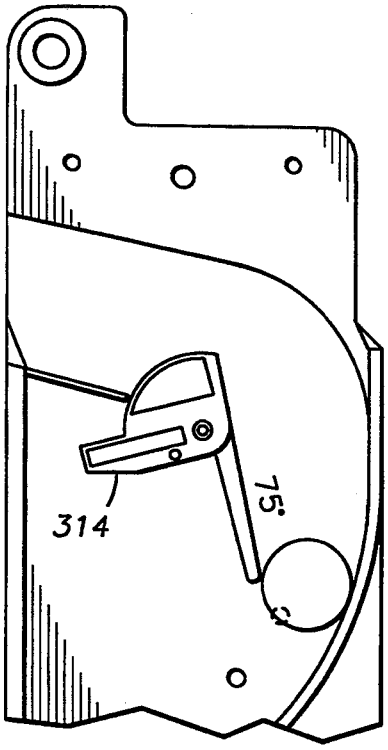

FIGS. 4A and 4B depict a dime in the coin chute 302. As the dime moves downward in the coin chute 302, the wake-up arm 314 rotates about 75 degrees before its contact with the edge of the dime ends. FIG. 4B shows the dime in contact with the sensor arc 322 just before it loses contact with the wake-up arm 314. After passing the wake-up arm 314, the dime continues through the coin chute along the sensor arc 322 as it passed the optical sensors 338. The configuration of the sensor arc 322 minimizes coin bounce and greatly improves on the consistency and accuracy of coin chord measurements.

Figure 5A:
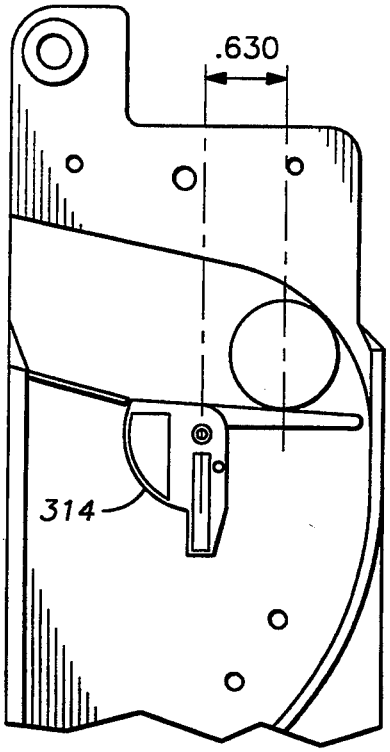
Figure 6A:
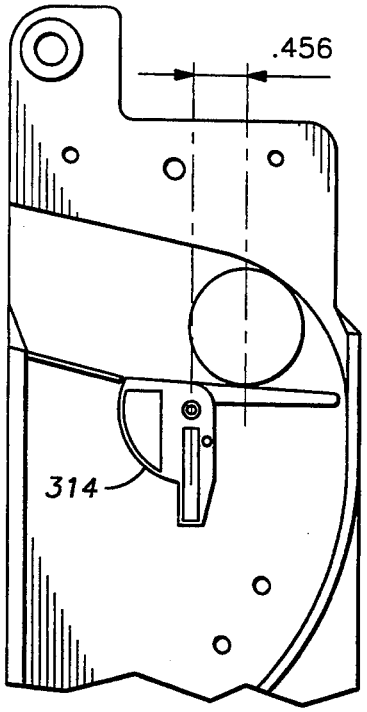

Larger coins such as nickels and quarters are heavier and require a greater opposing force to dampen their velocity and to reduce coin bouncing. FIGS. 5A and 6A show a nickel and a quarter, respectively, as the input arc 320 causes each to contact the wake-up arm upper surface 332 at different points depending on the diameter of the coin. As coin diameter increases, the distance between the coin's point of contact with wake-up arm upper surface 332 and the shaft 327 decreases. This results in increasingly greater dampening force from the counterweight, thereby providing a greater dampening force on larger coins than on smaller coins.

Figure 5B:
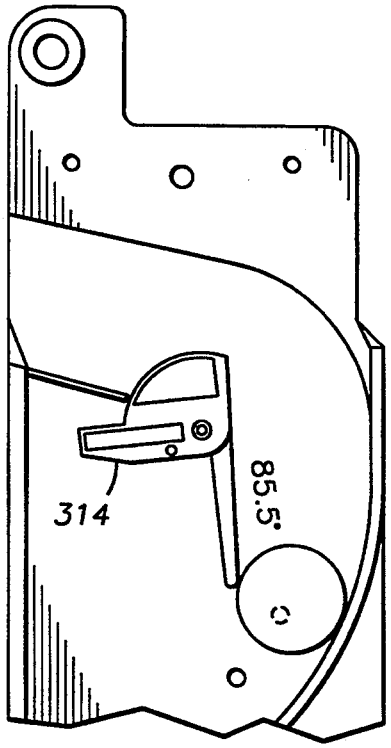
Figure 6B:
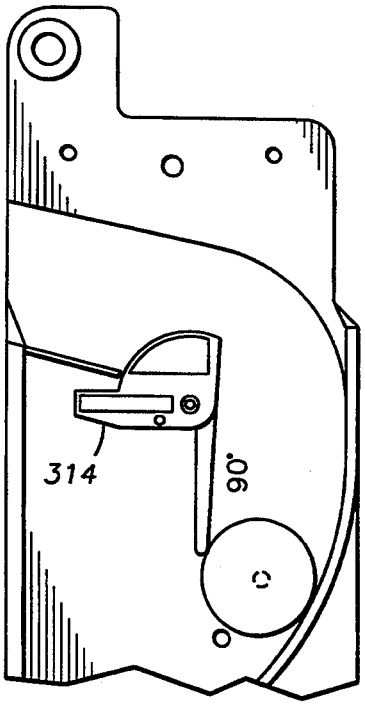

Referring now to FIGS. 5B and 6B, larger coins maintain contact with the wake-up arm 314 for a longer distance. Thus, the input arc 320 and the sensor arc 322, in conjunction with wake-up arm 314, provide a dampening and de-bouncing action that varies for each coin in direct proportion to the size and mass of the coin. This results in more consistent and accurate coin diameter measurements than is available in prior art apparatus.

The wake-up arm 314 is an important aspect of the present invention. It guides coins to and holds them against the arcuate shoulder 310. It provides a dampening action that varies directly with the mass of the coin. Thus, because larger coins contact the wake-up arm closer to its fulcrum, they are subject to a greater resistive force from the counterweight on the arm 314. Similarly, larger coins maintain contact longer with the arm 314 as they pass along the arcuate shoulder 310. This helps to minimize bounce and contributes significantly to more accurate optical measurements on coins.

THE COIN DELIVERY ASSEMBLY

As previously noted, the coin delivery assembly 400 includes those portions of the mechanism 200 that enable the mechanism 200 to release the door of the newspaper rack when the correct coin combination has been inserted in the mechanism. The coin delivery assembly 400 also comprises those portions of the mechanism 200 that deliver escrowed coins either to a collection compartment or to a coin return chute, depending on the circumstances. FIGS. 8, 9, and 11–14 depict the mechanism 200 in left side elevation so as to disclose the coin delivery assembly 400. Referring now to FIGS. 9, the coin delivery assembly 400 comprises a door latch assembly 402 and a coin return assembly 404.

The Door Latch Assembly

Figure 8:
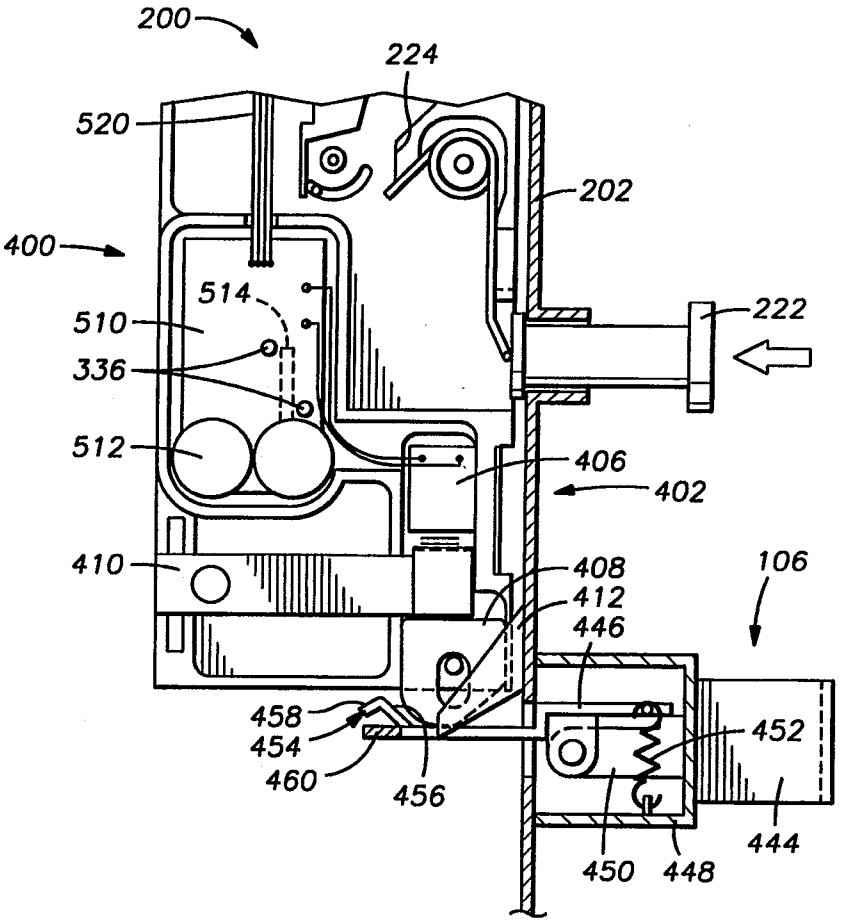
FIG. 8 is a partial elevational view of the left side of the coin mechanism of FIG. 2A and the rack door tongue illustrating a door catch release mechanism.
Figure 9B:
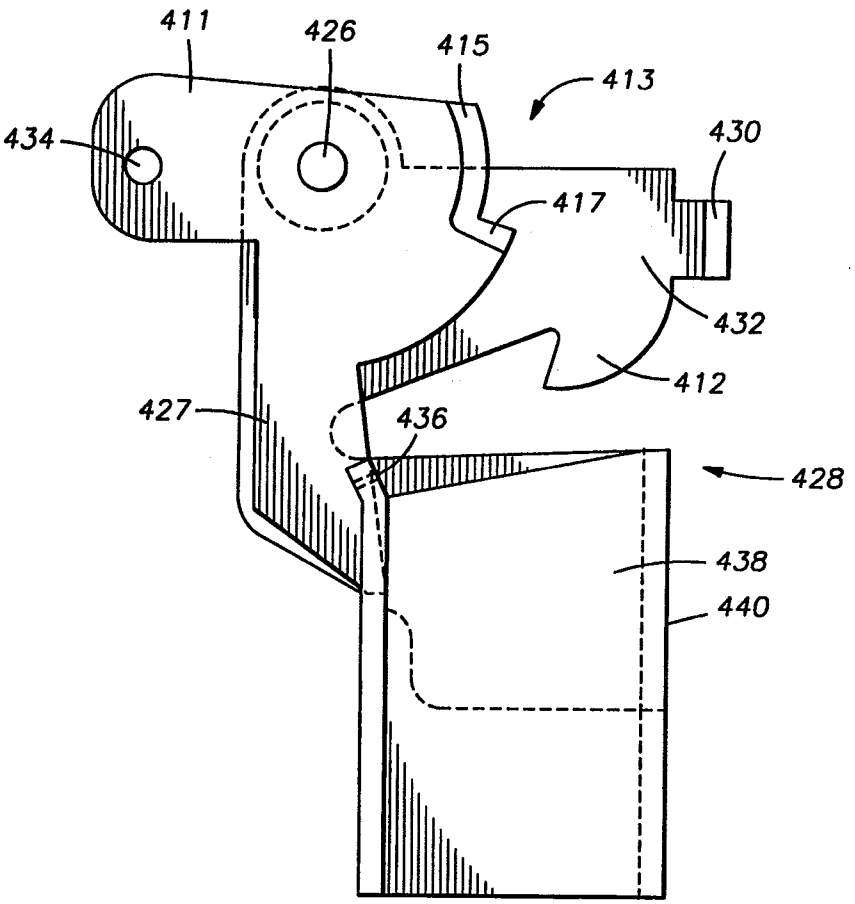
FIG. 9B is a left side elevational view of a bracket forming a part of the coin mechanism of the present invention.
Figure 9A:
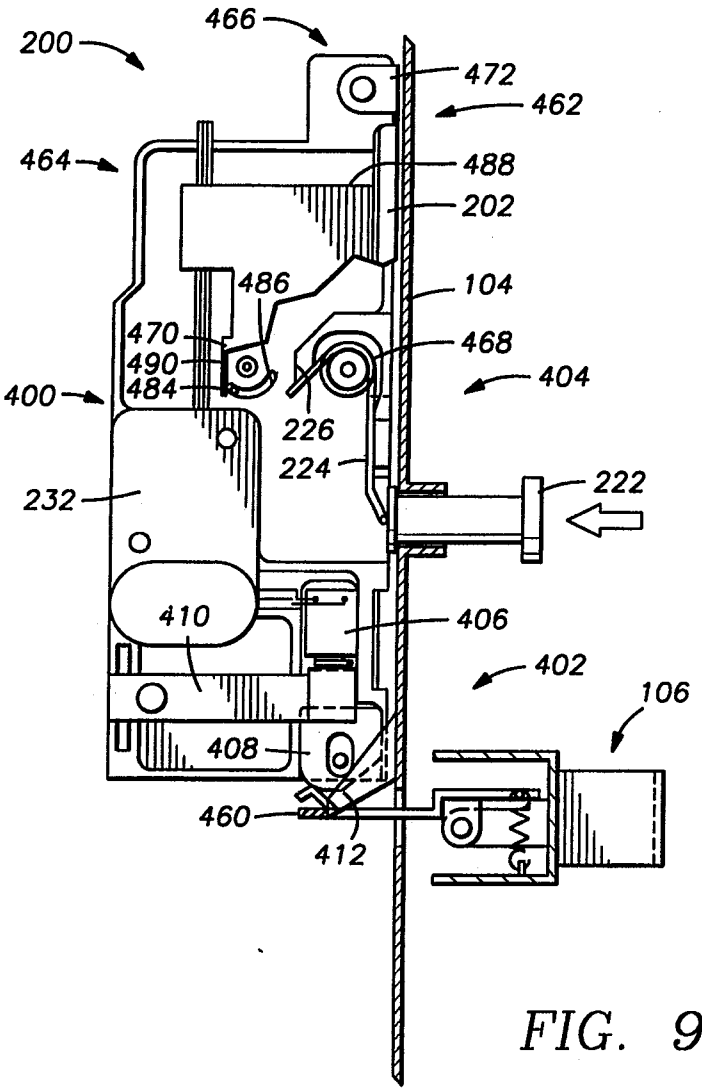
FIG. 9A is a full elevational view of the left side of the coin mechanism of FIG. 2A and the rack door tongue showing a coin return assembly.

Referring now to FIGS. 8, 9A, and 9B, the door latch assembly 402 controls access to newspapers stored within the rack by releasing or locking the rack door. It comprises a solenoid 406, a door latch 408, a door latch restraint 410, a reset arm 411, and a door tongue stop mechanism 412.

Figure 14A:
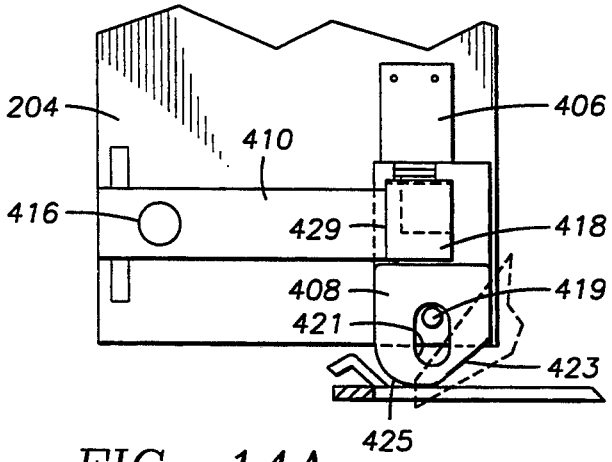
FIGS. 14A, 14C, and 14E each depict partial left side elevational views of the coin mechanism and the rack door tongue illustrating the release of the door tongue.
Figure 14B:
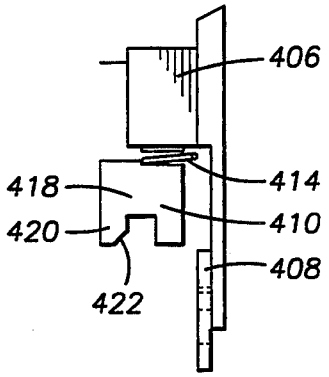
FIGS. 14B, 14D, and 14F each depict front elevational views of the coin mechanism shown in FIGS. 14A, 14C, and 14E, respectively.

The solenoid may be a device no. HAT-901 available from Hesco Corporation, operating on 185 mA of current at 6 volts in the active state. Referring to FIGS. 14A and 14B, which depict the door latch assembly 402 in partial left side elevation and partial front elevation (with the base plate removed), respectively, the solenoid 406 includes at its lower end a contact 414 that is spring biased away from the solenoid 406 in the normal (inactive) state.

The door latch restraint 410 is an arm, injection molded of a plastic material, pivotally affixed to the main body 204 at a rearward end 41 6 of the restraint 410 and spring biased toward the main body 204. The restraint 410 includes at its forward end a head 418 for engaging the contact 414 on the solenoid 406 and the door latch 408. As may be noted by reference particularly to FIG. 14B, the restraint head 418 includes along its left side a downwardly extending flange 420, which has an inside chamfer 422 that comprises a camming surface for biasing the restraint head 418 away from the main body 204 on contact with the reset arm 411, all as described more particularly below. Referring briefly to FIG. 14A, the restraint head 418 further includes a rearward inside chamfer extending perpendicularly from the rearward end of the inside chamfer 422 along a left rear edge 429 of the restraint head 418.

Figure 14C:
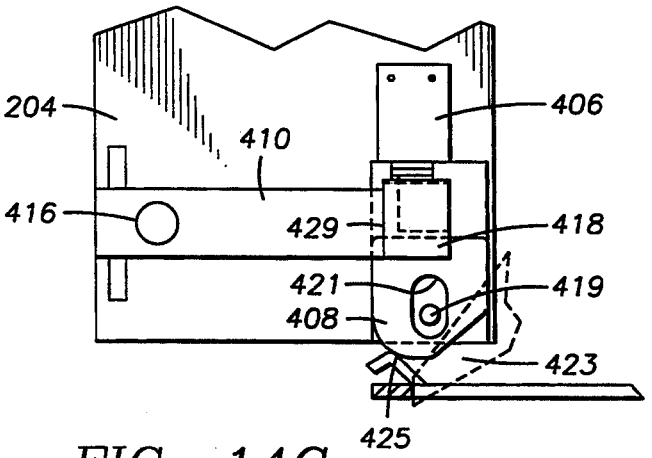
Figure 14D:
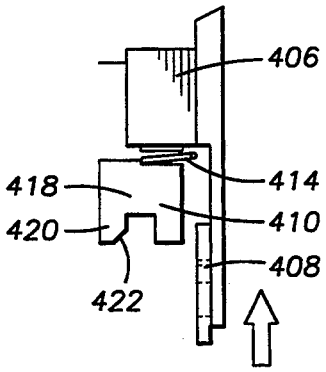
Figure 14E:
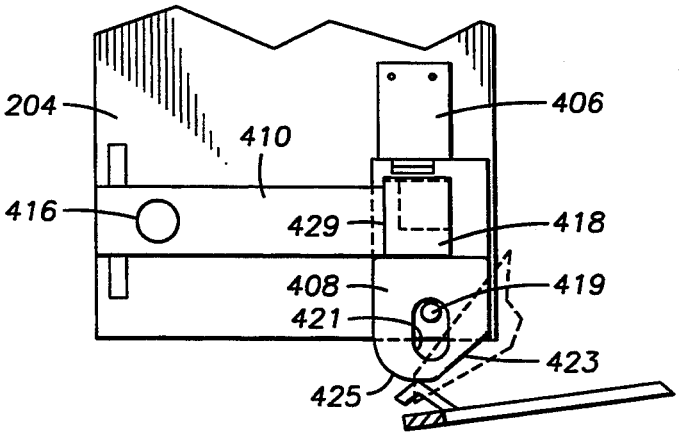
Figure 14F:
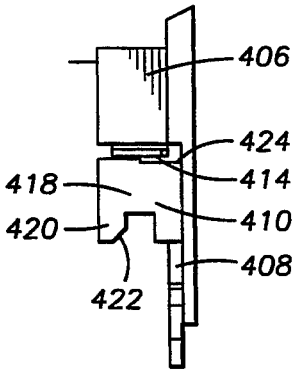

Referring still to FIG. 14F, the upper surface of the restraint head 418 includes a surface 424 downwardly offset from the upper surface by approximately 0.75 min. As may be seen in FIG. 14B, the downwardly biased contact 414 on the solenoid 406 engages a shoulder defined by the downwardly offset surface 424 when the restraint arm 410 is moved a sufficient distance away from the main body 204. When the solenoid 406 is active, the magnetic field extending through the solenoid 406 overpowers the spring bias on the contact 414 and draws the contact 414 against the solenoid 406, above the upper surface of the restraint head 418. With the contact 41 4 drawn against the solenoid 406, the spring on the rearward end 416 of the restraint 410 biases the restraint 410 against the main body 204.

The door latch 408 comprises a generally flat plate injection molded of a plastic material in the configuration depicted in FIGS. 14. It is slidably affixed against the left side of the main body 204 by means of a shaft 419 extending from the main body through a bore 421 in the latch 408 to a plastic latch support bracket (not shown), which extends around the latch 408 on three sides and engages the left end of the shaft 419. The latch 408 is normally biased, very lightly, in the downward position by a spring (not shown) and includes at its lower end a forward camming surface 423 and a rearward camming surface 425.

The latch 408, the shaft 419, and the bore 421 are sized and positioned such that at the lowest point of travel of the latch 408, the restraint head 418 on the door latch restraint 410 is biased over the top of the latch 408 and into contact with the main body 204, as depicted in FIG. 14F. The same members are also sized and positioned such that at the highest point of travel of the latch 408, the tongue on the door of the newspaper rack engages the tongue stop mechanism, as described in detail below.

The reset arm 411 is a generally flat plate injection molded of a plastic material in the configuration depicted in FIG. 9B. It includes a chamfered edge 413 having an upper portion 415 and a lower portion 417 for engaging the inside chamfer 422 on the head 418 of the door latch restraint 410 and camming the restraint 410 away from the main body 204 (FIG. 9A), as described more particularly below. The reset arm 411 also includes a downward extension 427 for engagement with a portion of the door of the newspaper rack, also as described below.

Figure 12:
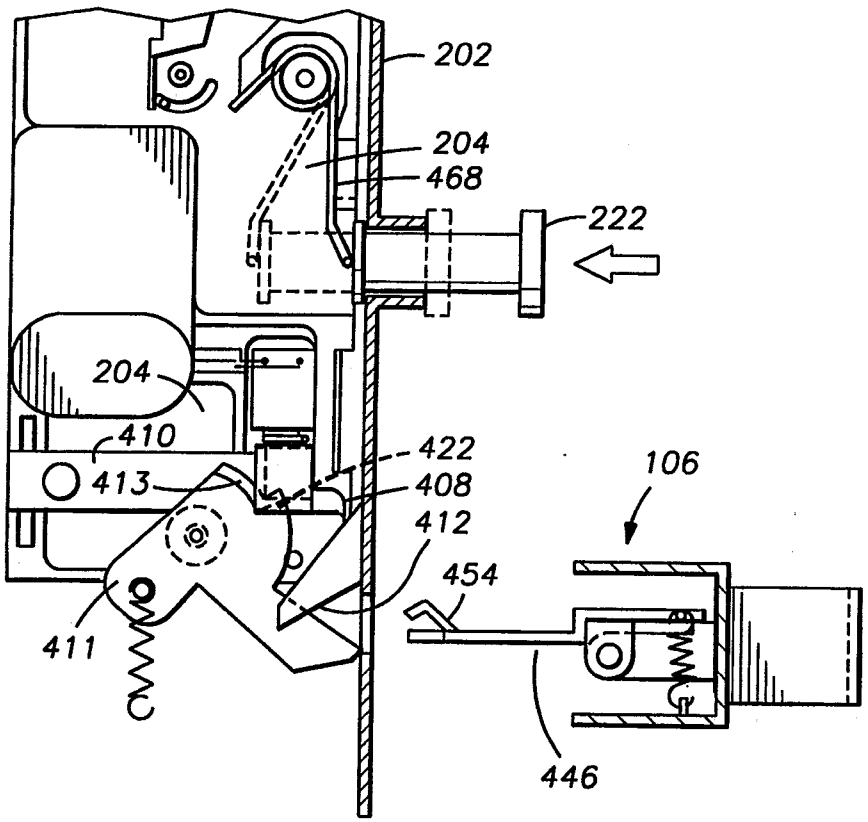
FIG. 12 is a partial elevational view of the left side of the coin mechanism and the rack door tongue, as shown in FIG. 11, with the rack door tongue released and removed.
Figure 11:
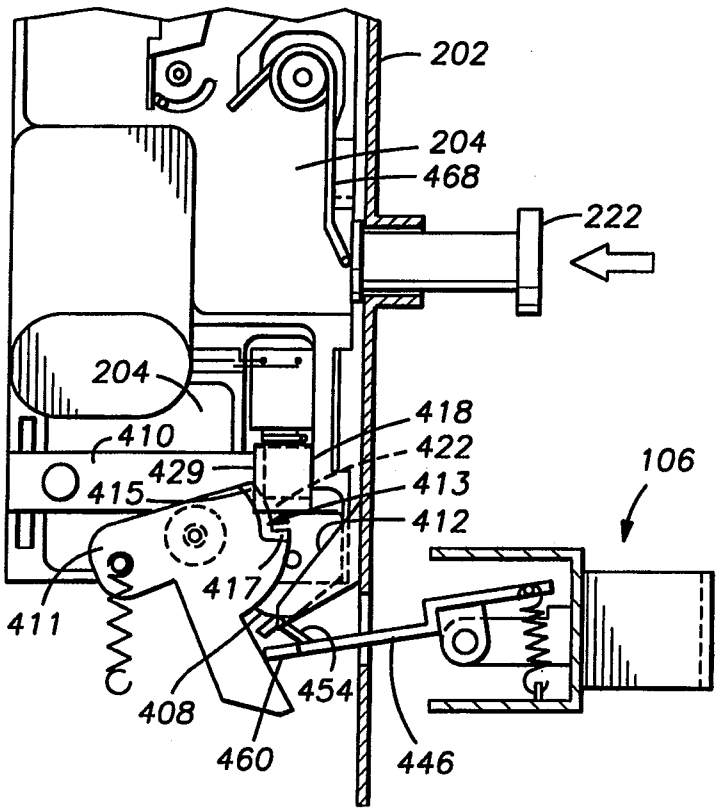
FIG. 11 is a partial elevational view of the lower left side of the coin mechanism of FIG. 2A and the rack door tongue further illustrating the coin release mechanism and its interaction with a coin return mechanism.

The reset arm 411 is rotatably attached on a shaft 426 to a tongue stop bracket 428, which forms a part of existing prior art newspaper racks of which the mechanism 200 will form a part. The bracket 428 includes a hook 430 that projects perpendicularly from the plane of the upper body 432 of the bracket 428. When installed in the rack, the upper body 432 is received through a slot 220 (FIG. 2A) in the base plate 202 and a corresponding slot in the housing 104 (FIG. 1), with the hook 430 engaging the front face of the housing 104 to prevent rearward motion of the bracket 428 relative to the base plate 202. In addition, the front face 440 of the bracket 428 is fixedly attached by means such as a screw to the back of the front face of the housing 104 (FIG. 1). FIGS. 11 and 12 depict the reset arm 411 (without the tongue stop bracket 428 that supports it) in the position it normally occupies relative to the door latch restraint 410 with the door partially and fully opened, respectively.

Referring still to FIG. 9B, a spring (not shown) connects through a hole 434 in the reset arm 411 to a hole 436 in a flange on the lower body 438 of the tongue stop bracket 428, thereby biasing the chamfered edge 413 on the reset arm 411 in a counter-clockwise rotation about the shaft 426 (as viewed in right side elevation in FIG. 9A). As the chamfered edge 413 rotates counter-clockwise in response to the spring load, the downward extension 427 on the reset arm 411 rotates forwardly.

The door tongue stop mechanism 412 is a downward and slightly inward, tooth-like extension on the underside of the upper body 432 of the tongue stop bracket 428. FIGS. 8 and 9 depict the mechanism 200 in left side elevation without the tongue stop bracket 428 in place, so that the door latch assembly 402 is more readily visible. For demonstrative purposes only, the door tongue stop mechanism 12 is modeled in FIGS. 8 and 9 (as well as FIGS. 11–13 and FIGS. 14A, 14C, and 14E) as a downward and rearward extension 412 from the rear face of the housing 104, whereby the position of the stop mechanism 412 relative to the other parts of the latch assembly 402 when the tongue stop bracket 428 is installed is apparent.

FIGS. 8 and 9A also depict a portion of a door 106 on an existing prior art newspaper rack as it engages the mechanism 200. The door 106 includes a handle 444, a tongue 446, and a tongue housing 448. The tongue 446 pivotally attaches to a tongue support bracket 450, which is fixedly mounted by means such as welding to the interior of the housing 448. When the door 106 is closed, the housing 448 protects the tongue 446 from vandalism or other tampering. The forward end of the tongue 446 is normally biased by means of a spring 452 against the upper surface of the bracket 450, whereby the tongue 446 is maintained in a generally horizontal plane.

The tongue 446 includes at its rearward end, along the right side of the tongue 446, an upward extension 454 forming a forward camming surface 456 and a rearward camming surface 458. When the door 106 is in the closed position, the forward camming surface 456 on the tongue 446 engages the downwardly extending flange 348 on the escrow compartment door 344, as shown in FIGS. 3 and 7, holding the door 344 closed when coins are present in the mechanism, whereby coins can accumulate in the escrow compartment 308. The tongue 446 also includes at its rearward end a tongue lock bar 460 extending perpendicularly from the tongue 446 away from the mechanism 200.

Operation of the Door Latch Assembly

Referring now to FIGS. 8, 14A, and 14B, the door 106 to the newspaper rack is in the closed position, prior to the receipt by the mechanism 200 of coins sufficient to meet or exceed the vend price. The door latch assembly 402 assumed the depicted configuration when the door 106 was opened or when the coin return assembly 404 was actuated, as described below, whichever event last occurred.

The door latch restraint 410 is positioned away from the main body 204, held in place there against the load of a spring by engagement of the contact 414 on the solenoid 406 with the downwardly offset surface 424 on the upper surface of the door latch restraint head 418. If one attempts to open the door 106, the door tongue 446 begins to move forwardly, with the forward camming surface 456 on the tongue 446 engaging the rearward camming surface 425 on the door latch 408.

The door latch 408, in response to the engagement of its rearward camming surface 425, slides upward adjacent to the main body 204, as shown in FIGS. 9, 14C, and 14D, past the door latch restraint 410. Because the spring load on the door tongue 446 is greater than the spring load on the door latch 408, the door tongue 446 is not cammed downward. Because the door tongue 446 is not cammed downward as it moves forward, the tongue lock bar 460 engages the door tongue stop mechanism 41 2, as shown in FIGS. 9A, 14C, and 14D, preventing the door 106 from opening. Total forward travel of the door tongue does not exceed approximately 8 min.

Referring now to FIGS. 14E and 14F, when the combination of coins in the escrow compartment meets or exceeds the vend price, the microprocessor in the control system, as described below, activates the solenoid 406 for approximately 30 milliseconds. The magnetic field generated by the solenoid 406 for that brief period pulls the solenoid contact 414 upward against the solenoid 406. With the contact 414 unseated from the surface 424 on the restraint head 418, the door latch restraint 410 moves under the contact 414 against the main body 204 in response to the load of the spring (not shown) on the restraint 410. When the solenoid 406 subsequently releases the contact 414, the restraint 410 is positioned against the main body 204.

When an attempt is made to open the door, the door tongue 446 moves forward, with the forward camming surface 456 on the tongue 446 engaging the rearward camming surface 425 on the door latch 408. The door latch restraint 410, which is biased against the main body 204, prevents substantial upward motion of the door latch 408. The door latch 408, being held in position adjacent the door tongue stop mechanism 412, cams the tongue stop bar 460 on the door tongue 446 beneath the stop mechanism 412 as shown in FIG. 14F, thereby allowing the door 106 to be opened.

Referring now to FIGS. 8 and 9A, when the rack door 106 is fully closed, the tongue lock bar 460 on the door tongue 446 engages the downward extension 427 on the reset arm 411, biasing the reset arm 411 approximately to the orientation depicted in FIG. 9B, with the upper surface of the reset arm 411 lying generally horizontal. As the door tongue 446 is withdrawn from the mechanism 200, the spring that biases the reset arm 411 causes the downward extension 427 on the arm 411 to follow the tongue 446, rotating forwardly about the shaft 426.

Referring now to FIGS. 11 and 12, as the upward extension 454 on the tongue 446 tracks the door latch 408, biasing the tongue lock bar 460 beneath the door tongue stop mechanism 412, the chamfered edge 413 on the reset arm 411 engages the inside chamfer 422 on the restraint head 418. Engagement between the two chamfers 413, 422 cams the door latch restraint 410 away from the main body 204, allowing the spring-biased solenoid contact 414 to seat itself against the shoulder defined by the downwardly offset surface 424 on the restraint head 418. The door latch assembly 402 now is reset.

THE COIN RETURN ASSEMBLY

The coin return assembly 404 includes the apparatus that enables a customer to obtain a return of the coins inserted into the coin mechanism, even after the coins meet or exceed the vend price, as well as the apparatus that clears obstructions from the coin chute. Referring to FIG. 9A, the coin return assembly 404 includes a main body pivot mechanism 462 and a coin chute clearing mechanism 464.

Main Body Pivot Mechanism

Referring still to FIG. 9A, the main body pivot mechanism 462 comprises a pivot block 466, a coin return spring 468, and a wake-up arm rotation mechanism 470. Referring to FIGS. 9A, 10B, 10C, and 13, the pivot block 466 comprises a bracket 472 forming a part of the base plate 202, a shaft 474, a sleeve 476, and a spring 478.

The bracket 472 is a pair of ears extending perpendicularly rearward from each side of the base plate 202 at its upper end. Both ears include holes for receiving ends of the shaft 474 therethrough. The shaft 474 extends from the right ear of the bracket 472, through a cylindrical bore in the upper end of the main body 204, through the generally cylindrical sleeve 476, and then through the left ear of the bracket 472, whereby the main body 204 can pivot on the shaft 474 relative to the base plate 202.

The spring 478 is a metal spring wound around the sleeve 476 and normally biases the main body 204 against the base plate 202. The spring 478 is braced at one end against the upper end of the base plate 202 and at the other end against a small extension 480 form the left side of the main body 204.

Figure 13:
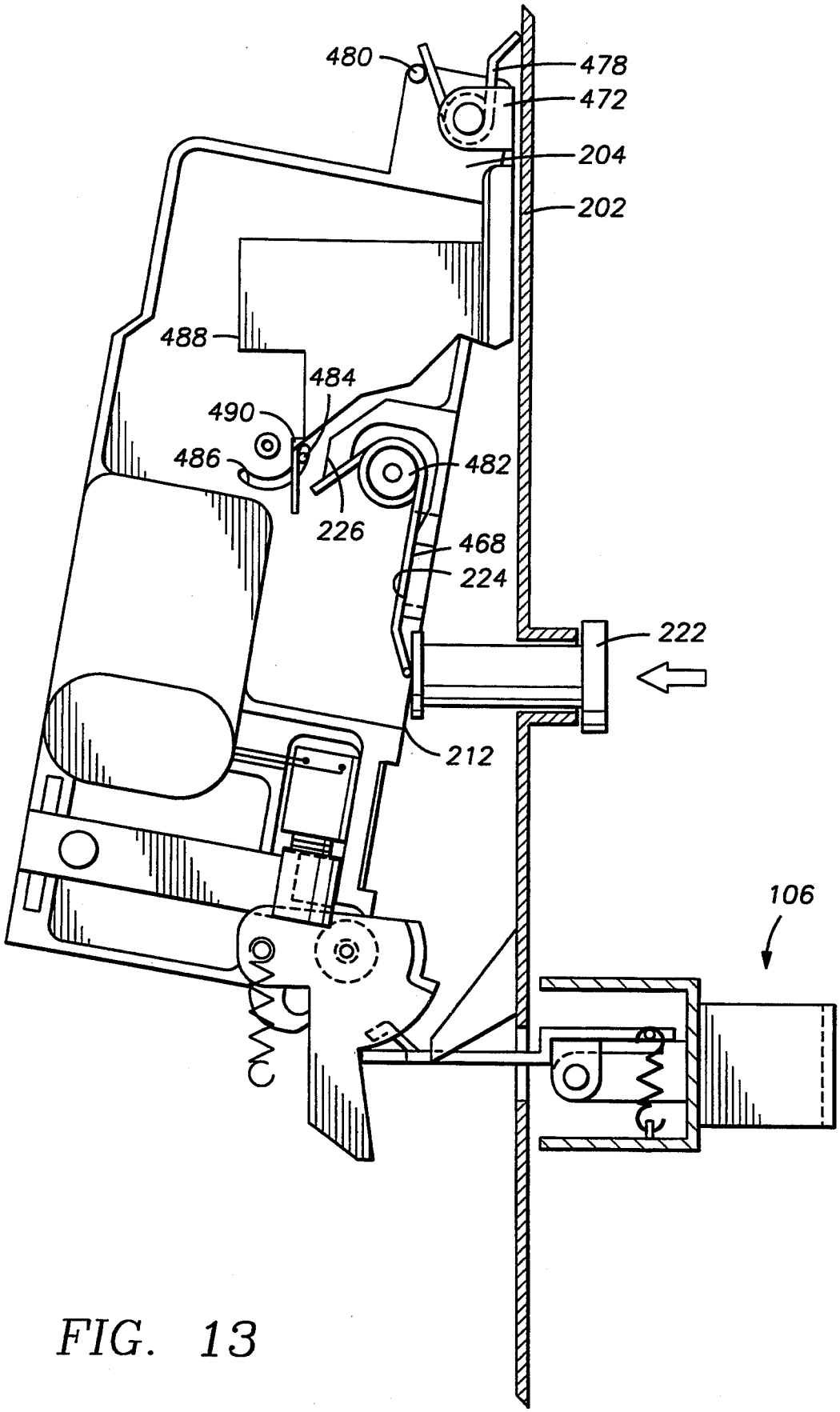
FIG. 13 is an elevational view of left side of coin mechanism of FIG. 2A illustrating the coin return mechanism.

Referring now to FIGS. 9 and 13, the coin return spring 468 comprises a heavy metal spring wound around a spring support 482, which is affixed to the side of the main body 204. One end of the coin return spring 468 engages a rearward-facing shoulder 224 machined in the main body 204, with a portion of the spring 468 extending across the circular hole 212 in the base plate 202 for engagement by a coin return button 222 on the newspaper rack. The other end of the spring 468 engages a forward-facing shoulder 226 machined in the main body 204.

The coin return spring 468 is stiffer than the pivot spring 478 in the pivot block 466, whereby pressure applied to the coin return spring 468 compresses the pivot spring 478. Use of the coin return spring 468 between the coin return button and the main body 204 effectively limits the force that may be applied to the coin return mechanism 200 through the coin return button 222. When the main body 204 reaches the rearward limit of its travel, or is prevented from moving rearward when the rack door is open, the coin return spring 468 compresses, absorbing excess inward travel of the coin return button 222.

Referring now to FIGS. 3, 12, and 13, the wake-up arm rotation mechanism 470 comprises a wake-up arm pin 484, a wake-up slot 486 in the main body 204, and a pivot bracket 488. The wake-up arm pin 484 is a small metal pin affixed in the wake-up arm 314 as indicated in FIG. 3. The pin 484 extends perpendicularly from the body of the wake-up arm 314 through the slot 486 and protrudes approximately 2 cm beyond the left face of the main body 204.

The wake-up slot 486 is an arcuate slot through the main body 204 having a radius of curvature that corresponds to the distance between the pin 484 where it joins the wake-up arm 314 and the shaft 327 on the arm 314. The slot 486 extends downward and forward for approximately 15 degrees from its upper end, which corresponds to the position of the pin 484 when the wake-up arm 314 assumes its normal resting position, as shown in FIG. 3. The slot 486 thereby defines the limits of travel of the wake-up arm 314.

FIG. 9A depicts the pivot bracket 488 in side elevation, with a portion cut away to reveal the wake-up slot 486 and the pin 484. The pivot bracket 488 is a metal plate extending generally perpendicularly rearward from the rear face of the base plate 202. It includes at the lower, rearward edge thereof a flange 490 that extends perpendicularly toward the main body 204, whereby pivotal motion of the main body 204 away from the base plate 202 (in response to pressure on the coin return button) causes the flange 490 to engage the wake-up arm pin 484 and rotate the pin 484 through the slot 486.

The Coin Chute Clearing Mechanism

A major cause of coin mechanism jamming and resulting failure to allow a vend is due to the insertion of items other than valid coins into the coin chute. These items can be anything from toothpicks to bits of metal. The coin entry slot 202 (FIG. 1) limits the size of an object that may be inserted to approximately 2.5 mm. thick and 2.8 cm. high. If a foreign object is round, it will usually roll through the coin chute and come to rest in the coin escrow compartment without being counted as a valid coin or otherwise affecting the further operation of the electronic coin mechanism 200. However, if a foreign object does not roll, it may remain in the coin chute above the wake-up arm or resting on the wake-up arm. To address this problem, the present invention provides for an automatic clearing of all such objects each time the coin return button is pressed.

Referring now to FIGS. 10A–10E, the coin chute clearing mechanism 464 translates rearward pivotal motion of the main body 204 relative to the base plate 202 into lateral pivotal motion of the right side cover 206 relative to the main body 204. This maneuver opens the coin chute to allow obstructions in the coin chute to pass through the coin return. The mechanism 464 comprises a camming pin 492 in the right side cover 206, a hole 493 through the main body 204, and a camming flange 494 on the pivot bracket 488.

The camming pin 492 is fixed to the right side cover 206 and projects generally perpendicularly from the side cover 206 through the hole 493 in the main body approximately 1.8 cm. beyond the left face of the main body 204. The hole 493 is slightly elongated to permit downward pivotal motion of the pin 492 with lateral pivotal motion of the side cover 206 at the bolt 207.

The camming flange 494 extends for approximately 2 cm. on an angle of approximately 15 degrees relative to the pivot bracket 488 toward the main body 204, whereby pivotal motion of the main body 204 relative to the bale plate 202 causes the camming flange 494 to engage the camming pin 492, forcing the end of the pin 492 toward the main body 204. As the pin 492 is pushed toward the main body 204, the right side cover 206 pivots laterally away from the main body. Thus, the coin chute clearing mechanism 464 translates rearward pivotal motion of the main body 204 relative to the base plate 202 into lateral pivotal motion of the right side cover 206 relative to the main body 204.

Operation of the Coin Return Assembly

Figure 15:
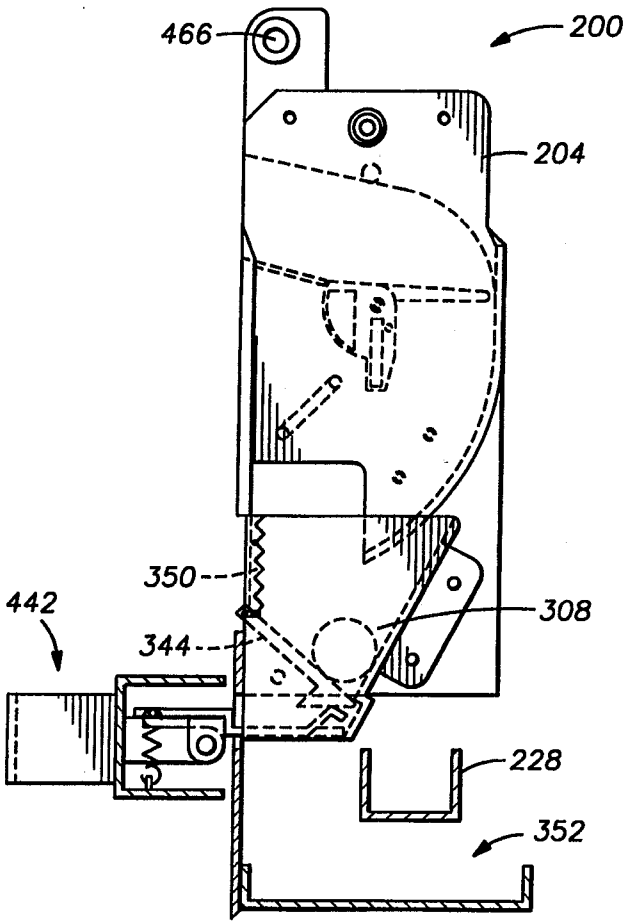

Referring now to FIG. 15 and 17, should a customer for some reason desire the return of coins deposited in the mechanism 200, the customer will press the coin return button 222. The coin return button 222 causes main body 204 to pivot rearwardly on the shaft 466, whereby the coin escrow compartment 308 is positioned directly above a coin return ramp 228 forming a part of existing prior art newspaper racks. This pivotal motion causes the coin escrow door 344 to slide along the upper surfaces of the upward extension 454 on the door tongue 446 until the coin escrow door 344 is clear of the door tongue 446.

As the coin escrow door 344 clears the door tongue 446, it pivots open due to weight of one or more coins in the escrow compartment 308 overcoming the spring tension on the door 344, allowing the coin or coins to fall into the coin return ramp 228. Coins received in the coin return ramp 228 slide down to a coin return chute opening in the front of the rack (FIG. 1), whereby the customer can retrieve the coins.

All coin mechanisms must prevent the customer from getting both the product vended as well as the return of the money placed into the coin mechanism. Most coin mechanisms accomplish this feat by immediately disabling the coin return function once the vend price has been reached. The present invention allows the customer to obtain his or her money back even after the full vend price has been inserted into the mechanism. Thus, a customer who does not notice until after all of the money has been inserted into the coin mechanism that the publication in the rack is not the latest edition can obtain a return of the money inserted.

A coin mechanism constructed in accordance with the principles of the present invention employs a unique means for allowing either a paper vend or a coin return action even after full vend price has been reached and for making sure that the two actions are mutually exclusive. Referring to FIG. 11, this requires that once the lock bar 460 on the tongue 446 has cleared the door tongue stop mechanism 412, the coin return action must be disabled and remain disabled as long as the paper access door is open beyond this point.

Alternatively, if the customer elects to have coins returned, the coin return action must prevent the paper access door from being opened before coins are returned and must reset the mechanical door latch. In addition, the coin return action must not occur before the internal RAM accumulator memory has been reset to zero, as described in detail below.

Referring still to FIG. 11, the paper access door is open beyond the restriction imposed by the door tongue stop mechanism 412. The upper portion 415 of the chamfered edge 413 of the reset arm 411 has engaged the inside chamfer on the left rear edge 429 of the restraint head 418, whereby the reset arm 411, which is fixedly attached to the tongue stop bracket 428 (FIG. 9B, as described above), prevents rearward pivotal motion of the main body 204 relative to the base plate 202. This prevents a coin return action after a customer has begun to open the rack door.

Because the main body 204 is unable to move in response to the coin return button 222, the coin return action is effectively disabled. Instead, pressure on the coin return button 222 merely compresses the coin return spring 468, which thereby limits the force that may be applied against and protects the reset arm 411. By design, disablement of the coin return action occurs before the door tongue 446 clears the door tongue stop mechanism 412.

Referring to FIG. 12, engagement of the lower portion 417 of the chamfered edge 413 of the reset arm 411 with the inside chamfer 422 on the restraint head 418, cams the door latch restraint 410 away from the main body 204, resetting the door latch assembly.

Referring now to FIGS. 10A–E, pressure on the coin return button, in addition to pivoting the main body 204 rearward, deflects the right side cover 206 outward against the force of the compression spring 209. The compression spring 209 forces the right side cover 206 back against main body 204 after the coin return action is completed. This action allows any foreign matter at top of the coin chute to fall downward and into coin return ramp 228 (FIG. 17).

Referring to FIGS. 7 and 13, a further action to assist in the clearing of top of coin chute is the rotation of the wake-up arm 314 during the above-described clearing action. When the coin return button 222 is depressed, the wake-up arm pin 484 rotates in response to contact with the flange 490 on the pivot bracket 488. Thus, pressing the coin return button 222 causes the wake-up arm 314 to rotate in the same manner as if a coin were inserted into the coin chute. As is evident from an examination of FIGS. 4, 5 and 6, this action will dislodge any foreign matter lodged in the area above wake-up arm 314.

Referring now to FIG. 7, rotation of the wake-up arm 314 in response to pressure on the coin return button causes closure of the wake-up reed switch 334. Well before the coins are delivered to the coin return ramp, the wake-up reed switch 334 detects the permanent magnet 331 on the arm 314 and sends a signal to the microprocessor in the control system, as described below. If the microprocessor does not immediately thereafter detect the presence of a coin by means of the optical detector system 306, it treats this event as a coin return action and immediately resets the system. Thus, the same switch 334 activates the microprocessor and, in combination with optical detector system 306, identifies a coin return operation, thereby avoiding the need for an additional reed switch for sending a reset signal to the microprocessor.

The Control System and Sequence of Operation

Figure 18:
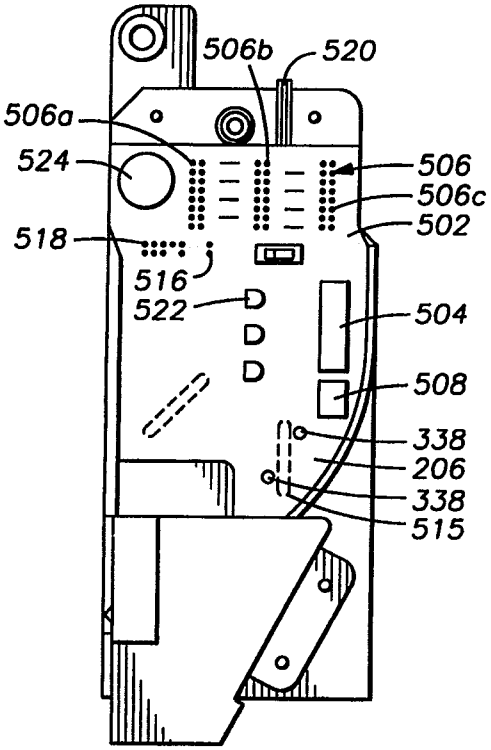
FIG. 18 is an elevational view from the right side of the coin mechanism of FIG. 2A showing a main circuit board.
Figure 19:
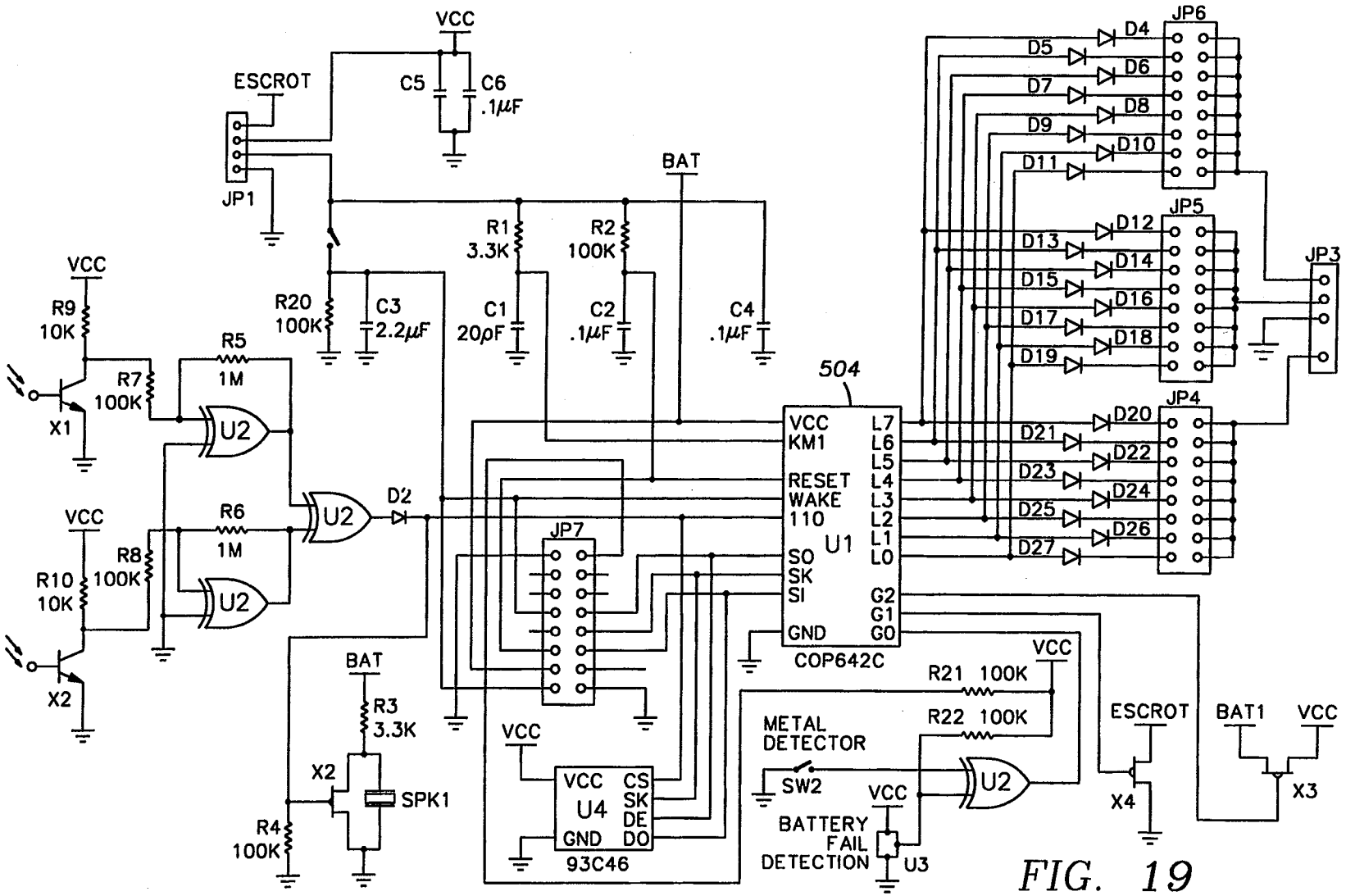
FIG. 19 is a schematic diagram of the microprocessor-based control system for the coin mechanism of the present invention.

The control system for the coin mechanism is based around a microprocessor 504 (FIG. 18), such as a device no. COP842C manufactured by National Semiconductor Corporation, or a device with equivalent or superior capabilities. FIG. 19 depicts a schematic diagram of the control system. Set forth below in Table I is a list of the electrical components that comprise the control system. The list is cross-referenced to the components depicted in FIG. 19. The control system will be described first in connection with the sequence of operation of the mechanism. FIG. 7 depicts the sequence of operation of the coin chute assembly 300 as a coin passes through the mechanism 200.

Referring now to FIG. 7, P1 shows a coin going into the coin chute 302 after it has been inserted into coin entry slot 208. P2 depicts the point at which the coin first contacts the input arc 320 and the upper surface of the wake-up arm 314. The weight of the coin causes the wake-up arm 314 to rotate until the permanent magnet 331 moves into alignment with the wake-up reed switch 334 as shown at P3.

The wake-up reed switch 334 is mounted on a main circuit board 502 (FIG. 18) and is normally in an open (nonconducting) state. After the wake-up arm 314 has rotated approximately 10 degrees, the magnetic field emanating from the permanent magnet 331 causes the wake-up reed switch 334 to close, sending a wake-up signal to the microprocessor. The microprocessor then activates the power to the infrared light sources 336, as well as the power to the remainder of the electronic circuit comprising the control system.

P4 depicts the coin just before it blocks the infrared light from the upper light source **336*a*. P5 depicts the coin blocking the upper infrared light source 336*a* and closing on the lower infrared light source 336*b*. P6 shows the coin blocking the lower infrared light source 336*b*, immediately after the coin passed the upper infrared light source 336*a*. P7 shows the coin immediately after it passes the lower infrared light source 336*b***.

A complete explanation as to how this process generates the signals required for determining the coin chord measurement is set forth in U.S. Pat. No. 4,509,633 issued to Chow, which has been incorporated herein by reference. Generally, the microprocessor measures the time required for a coin to traverse a Known distance between the two light sources 336, from which a coin velocity can be computed, and the time required for the coin to pass by a light source 336. Given the velocity computation and the time measurement, a coin chord can be computed.

After the coin has passed the lower infrared light source **336*b* as shown at P7, the microprocessor computes the length of the chord traced by the light sources 336 across the coin, compares the same to a table of acceptable chord values located in RAM memory in the control system, and if the coin is valid, places the denominational value of the coin into an accumulator within the RAM memory. The microprocessor then compares the total accumulated value in the accumulator with the vend price, and if the value equals or exceeds the vend price, as determined by reference to price setting jumpers (FIG. 18), energizes the solenoid 406 (FIG. 9A**) for a 30 millisecond time period.

If the coin value total in the accumulator is less than the vend price, the microprocessor shuts down all power and returns to the sleep state, awaiting the next coin. During the sleep state, all power to electronic components is cut off, other than power to the microprocessor, which draws less than 10 microamps during the sleep state. The microprocessor is able to retain any accumulated coin values in RAM memory even during the sleep state. When the full vend price has been accumulated and the solenoid has been energized for 30 milliseconds, the microprocessor clears the internal RAM memory accumulator and returns to sleep state.

FIG. 15 depicts the electronic coin mechanism 200 in right side elevation with a coin in the escrow compartment 308. For purposes of illustrating the operation of the mechanism 200, it is assumed that the vend price has been accumulated and the latch control release solenoid 406 has been activated, causing door latch restraint 410 to limit upward movement of door latch 408 when an attempt is made to open the rack door 106.

Figure 16:
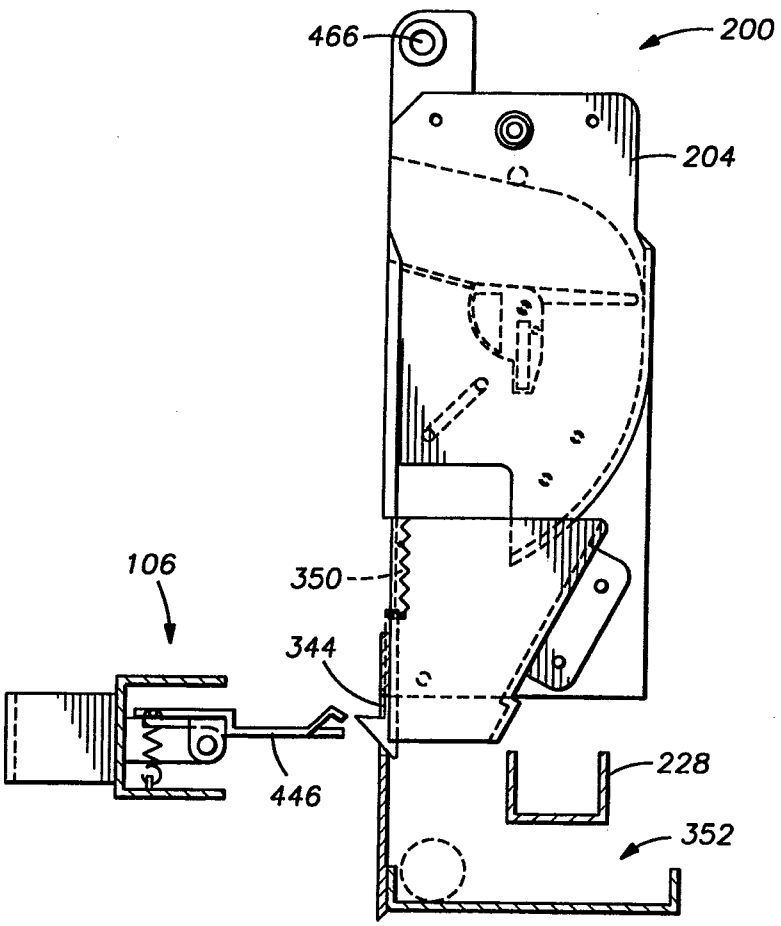
FIGS. 15–17 are elevational views of the right side of the coin mechanism of FIG. 2A from right side, with operative portions of the coin path shown in phantom, accumulation of coins in a coin escrow compartment, a coin collection box, and a coin return slot, respectively.

FIG. 16 depicts the door 106 opened to the extent that door tongue 446 is fully outside mechanism 200. The weight of the coin in the escrow compartment 308 has forced the escrow compartment door 344 to move downward and forward against the force of the extension spring 350. The vertical position of coin escrow door 344 in FIG. 16 is only momentary (and shown for clarity) in this position, as the tension of extension spring 350 will pull the coin escrow door 344 to its closed position, as shown in FIG. 15, the moment that the weight of the coin leaves the top surface of the coin escrow door 344.

FIG. 16 also depicts a coin collection box 352, into which the coins fall after the paper access door 106 has been opened. The transfer of coins from the escrow compartment 308 to the coin collection box 352 occurs well before the paper access door 106 can be opened far enough for anyone to interfere with this transfer.

Each time the wake-up reed switch 334 signals the microprocessor as described above, the microprocessor:

1. turns on all power to the infrared light sources 336 and to the electronic circuit comprising other parts of the control system;
2. reads the active vend price as determined by one of three switch-selectable rows of price jumpers and stores this value in ram memory;
3. reads the acceptable coin chord ranges stored in an electrically erasable programmable read only memory (EEPROM) 508, which may be, for example, a device no. NM93C46EN manufactured by National Semiconductor Corporation (FIG. 18) for each denominational coin value and stores same in RAM memory; and 4. starts an internal timer that expires if a coin has not blocked the upper light source 336 within a predefined time period.

This foregoing sequence of operations for a single coin occurs in slightly less than 100 milliseconds and draws less than 50 milliamps of current. The solenoid activation draws about 185 milliamps for 30 milliseconds.

The electronic components comprising the control system are mounted on the main circuit board 502 (FIG. 18) on the right side cover 206 and on a secondary circuit board 510 (FIG. 8), which is connected to the main circuit board 502 via a connecting ribbon cable 520. FIG. 18 depicts the mechanism 200 with the main body 204 detached from the base plate 202. In addition, a cover normally protecting the electronic components on the main circuit board 502 and some of the electronic components themselves have been removed for clarity. As shown in FIG. 18, the main circuit board 502 is mounted on the right face of the right side cover 206 (under the protective cover). The optical sensors 338 are positioned at the lower rear portion of the main circuit board 502.

Referring now to FIG. 8, the secondary circuit board 510 supports a lithium battery pack 512, the pair of infrared light sources 336, and a permanent magnet 514 for detecting ferrous content in coins. The permanent magnet 514 is mounted beneath secondary circuit board 510, centered between the infrared light sources 336.

The magnetic field emanating from the permanent magnet 514 on the secondary circuit board 510 (FIG. 8) is sufficiently strong to maintain a ferrous detector reed switch 515 on the main circuit board 502 (FIG. 18) in a closed condition. Referring to FIG. 18, the ferrous detector reed switch 515 is located on the underside of main circuit board 502. In the event that a coin having some ferrous content passes through the coin chute 302, it will decrease the magnetic field emanating from the permanent magnet 514 and cause the ferrous detector reed switch 515 to open momentarily. This sends an interrupt signal to the microprocessor 504, which causes the microprocessor to reject that coin and reset its internal RAM accumulator memory to zero.

United States coins currently have no ferrous content. However, many foreign coins such as Canadian, German, and Mexican coins, have ferrous content. The present invention includes a ferrous detector bypass jumper 516 (FIG. 18), which permits the electronic coin mechanism 200 either to accept or reject ferrous coins. For example, this option allows a newspaper rack to reject Canadian coins on the United States side of the border and to accept both Canadian and United States coins on the Canadian side of the border. When no jumper is present, ferrous content coins will be rejected. When a jumper is present, United States and foreign coins will be accepted if they meet dimensional requirements.

The right side cover 206 is easily removable to allow the operator periodically to clean the coin chute 302 of any accumulated dust, grit, or other deleterious matter.

Referring to FIG. 18, the main circuit board 502 includes a serial communications port 518, which is used initially to test the final assembled coin mechanism 200 and to store allowable coin ranges into the EEPROM 508. The communications port 518 can also be used to reprogram the electronic coin mechanism 200 for additional or different coins. This allows the flexibility of adding new United States coins that may be minted in the future or adding coins of other countries merely by reprogramming the electronic coin mechanism.

Referring still to FIG. 18, a main operating program for the microprocessor 504 is stored in an on-chip masked ROM. The operating program is constructed consistently with the principles disclosed in the Chow patent, modified as necessary to account for the improvements disclosed herein. The variable coin chord data is stored in the EEPROM 508. The EEPROM 508 will maintain its data even when not connected to a battery. Therefore, a power failure will not affect the coin data. Similarly, the on-chip masked ROM is not affected by power failures.

The microprocessor 504 also includes an internal RAM memory that does require power. The RAM memory is used by the microprocessor 504 to store the value of accumulated coins until the vend price is obtained. Thus, if a power failure occurs after coins have been inserted and their values accumulated in the RAM memory, that data will be lost. In the event of a power failure, the customer can obtain a return of inserted coins by pressing the coin return button, as described previously.

The price setting jumpers 506 on the main circuit board 502 comprise three columns of 2×8 pins extending upwardly from surface of board 502. These are used in the control system in the same manner as a DIP switch is used in the Chow patent. For further detailed explanation as to the function of the jumpers 506 in the control system, reference is made hereby to the Chow patent, U.S. Pat. No. 4,509,633.

The U.S. newspaper industry has up to three different price requirements during a typical week. For that reason, the present invention contains three columns of 2×8 pins, including a column **506*a* for a Daily price, a column 506*b* for a Sunday price and a column 506*c* for a Special edition price. Only one of the three columns can be active at any given time, and the selection preferably is made by a three position key lock price change switch 114 (FIG. 1). This allows the rack service person to change the price setting through the use of a key without accessing the inside of housing 104** where the collected coins are stored.

Each column of jumpers 506 includes eight rows of pins. Rows 1 through 7 of each set of jumpers 506, beginning from the bottom, are used for price setting and the top row of pins are used to enable a special token, as describe below. By using a binary code, the seven sets of jumpers can represent up a $6.35 price in 5-cent increments.

The top row of jumpers in each set of jumpers 506 is used to enable a token for special paper promotions. A newspaper publisher may wish for promotional purposes to provide prospective long-term customers with a given number of promotional copies. To accomplish this, the publisher could distribute a special token and program the electronic coin mechanism 200 to release the rack door on insertion of the token. The token could be valid for any or all of the three price ranges. By jumper connecting the top two pins of any set, the mechanism 200 is enabled to accept the special token for that particular edition, regardless of the price setting for that set of jumpers.

Each day a typical newspaper vending rack 100 is refilled with papers at least once. In order for this to be done as quickly as possible, the microprocessor is programmed to accept a single slug of a specific dimension under all price combinations. This service slug goes into the coin collection box in the same manner as normal coins. The person collecting the coins then can check that the rack has been serviced each day by counting the number of slugs in the collection box. The slug can be of any size able to fit through the coin chute and not conflicting with other acceptable coins. The service slug diameter and its value, i.e., its ability to open the rack with just one coin, regardless of price setting, is stored within EEPROM 508.

The present invention relies solely on battery power for its operation. Thus, it is critical that power usage by the control system is kept to a minimum. The microprocessor preferably draws a maximum current of 10 microamps during the sleep state, with the typical current draw being less than 1 microamp. Because of this low current draw during the sleep state together with the very short time that the unit is processing coins, a typical double-cell lithium battery pack can last up to 10 years while vending 30 papers per day. This 10 year operating life is under ideal indoor temperature conditions. Outdoor use entails operating within temperature ranges of −40° F. to +140° F. These temperature ranges can affect battery life significantly. Only lithium batteries will last as long as 10 years and yet be able to function reliably at the required temperature ranges.

The greatest power consumption of the control system occurs when the infrared light sources 336 are active while a coin is being processed. As noted, this process normally requires approximately 100 milliseconds per coin. Assuming a maximum of five coins per paper, at 30 papers per day, the infrared light sources 336 would be turned on for about 15 seconds every 24 hours. The door latch control release solenoid 406 would be energized for about 3 seconds every 24 hours. Thus, the sleep mode power usage must be very low in order to avoid excessive power drain on the battery pack 512.

FIG. 8 shows the battery pack 512 plugged into the secondary circuit board 510 on the back side of the main body 204. As described above, the secondary circuit board mounts two infrared light sources 336, which create the two light paths contacting surface of the optical sensors 338 located on the main circuit board 502 within the right side cover 206, as shown in FIG. 18. The secondary circuit board 510 supplies power to the main circuit board 502 and communicates with same through the connecting cable 520. The entire secondary circuit board 510, including the battery pack 512, is covered and kept protected from the elements by a removable protective cover 232, as shown in FIG. 9A. The latch control release solenoid 406 connects to the secondary circuit board 510.

Referring again to FIG. 18, the preferred embodiment of the present invention further includes a low battery power detector 522 that checks the battery power each time the person loading the rack inserts the service slug to open the paper access door 106. If the battery pack 512 is low, an audible piezo alarm 524 will emit a series of beeps to alert the operator of the need to change the battery pack 512. An alternative method for alerting the operator would be to use an LED in place of the alarm 524. The LED could blink a predetermined number of times if the battery pack 512 is low.

Referring now to FIG. 9A, in the event of battery failure or electronic control failure, the latch control release solenoid 406 will not be activated and the customer will be able to obtain a return of his or her money by depressing the coin return button. Likewise, the coin return action will return coins in the event that a mechanical failure prevents the door latch restraint 410 from moving toward main body 204 and blocking the upward movement of door latch 408.

While a preferred embodiment of the present invention has been shown and described, modifications thereof can be made by one skilled in the art without departing from the spirit of the invention.

TABLE I

| Component | Type | Part No./Value |
|---|---|---|
| U3 | Low Power Battery | Motorola MC34164P-5 |
| C1 | Ceramic Disc-Capacitor | 22pF |
| C2, C4, C5 and C6 | Tantalum Capacitor | 0.1 μF |
| JP1 | Power Connector | 4 pin |
| D1 thru D27 | Diode | NSC 1N914 |
| X4 and X5 | Field-Effect Transistor | 2N2700 |
| X3 | Field-Effect Transistor | VPO300L |
| U1 | Microprocessor | NSC COP842C |
| U4 | EEPROM | NSC NM3C46EN |
| U2 | XOR Gate | NSC 74AC86PC |
| SPKR | Piezzo Speaker | |
| R7, 8, 20, 2, 21, 22, and 4 | Resistor | 100K ohm, 1/8 w |
| R9 and 10 | Resistor | 10K ohm, 1/8 w |
| R5 and R6 | Resistor | 1 M ohm, 1/8 w |
| R3 and R1 | Resistor | 3.3K ohm, 1/8 w |
| SW1 and SW2 | Reed Switch | SPST |
| X1 and X2 | Photo Transistor | Optron OP505A |

What is claimed is:

1. A coin totalizer, comprising:

means for handling a coin, said handling means including an arcuate shoulder, said arcuate shoulder defining a path traversed by the coin in response to the force due to gravity;

means forming a part of said handling means for conducting the coin against said arcuate shoulder, said conducting means comprising a body rotatable about a shaft, said body having a projection with an upper surface for engaging the coin, said projection extending into said coin path in position to conduct the coin against said arcuate shoulder, and said projection being downwardly rotatable about said shah in response to contact with the coin to permit passage Of the coin between said projection and said arcuate shoulder;

means for detecting the value of the coin traveling along said arcuate shoulder after the coin has been engaged by said conducting means; and means for holding the coin after it has passed said detecting means.

2. A coin totalizer according to claim 1, wherein said body includes a counterweight that opposes downward rotation of said projection, said counterweight biasing said projection against the coin and biasing the coin against said arcuate shoulder.

3. A coin totalizer according to claim 1, wherein:

said arcuate shoulder includes an upper arc and a lower arc, the upper arc being at least partially above the coin and the lower arc at least partially supporting the coin as it moves along said coin path; and the upper arc converges toward the upper surface of said projection to trap the coin therebetween, the point at which the coin contacts the upper surface being a distance from said shaft that varies inversely with the diameter of the coin, whereby the moment of inertia applied by any coin on said body is relatively constant.

4. A coin totalizer according to claim 3, wherein:

said detecting means lies along the lower arc;

the upper surface of said projection maintaining contact with the coin at least until the coin passes onto the lower arc, whereby said body conducts the coin smoothly along said arcuate shoulder to said detecting means with a minimum of bounce.

5. A coin totalizer according to claim 3, wherein the magnitude of an arc defined by rotation of said projection in response to contact by the coin varies directly with the diameter of the coin, whereby said body conducts larger coins farther into the lower arc than it conducts smaller coins.

6. A coin totalizer according to claim 1, wherein said detecting means comprises at least one optical sensor that detects an edge of the coin.

7. A coin totalizer according to claim 1, wherein said handling means comprises a first means for guiding coins, said first guiding means having said arcuate shoulder formed therein; and a second means for guiding coins, said second guiding means being pivotably secured at an upper end thereof and biased against said first guide means, said first and second guiding means defining therebetween said coin path and supporting therebetween said rotatable body.

8. A coin totalizer according to claim 7, further comprising:

means for holding coins received from said handling means; and means for returning coins in said handling means, said coin return means including, means for causing said second guiding means to pivot away from said first guiding means, and means for causing said rotatable body to rotate about said shaft, whereby any foreign matter trapped in said coin path may be cleared from said handling means.

9. A coin totalizer according to claim 8, further comprising:

means responsive to said coin value detecting means for accumulating the value of coins in said holding means and storing said value in an accumulator; and means for detecting motion of said rotatable body and resetting said value in said accumulator to zero, whereby actuation of said coin return means causes said value in said accumulator to be reset to zero.

10. A coin mechanism for locking and unlocking a vending machine, the machine having a door with a tongue, comprising:

means for locking and unlocking the door tongue;

means for handling coins inserted into said mechanism;

means for determining the denomination of a coin in said handling means;

means for holding coins after said determining means has determined their denomination said holding means having a single door, said holding means door resting on and being maintained in the closed position by the vending machine door tongue;

means for collecting coins from said holding means, said collecting means receiving coins from said holding means when said holding means door opens;

means for accumulating the value of coins in said holding means; and means for releasing the vending machine door tongue when the value of coins in said holding means meets or exceeds a predetermined value, said holding means door being opened when the door tongue is withdrawn from said mechanism.

11. A coin mechanism for a newspaper vending machine, comprising:

means for receiving and identifying coins inserted into said mechanism;

means for holding coins from said receiving and identifying means;

means for returning coins collected in said holding means, including means for disabling said coin return means when the vending machine is opened;

means for actuating said coin return means, said actuating means being accessible from the exterior of the vending machine;

said actuating means being coupled to said coin return means by a spring, said spring compressing in response to actuation of said actuating means when said coin return means is disabled, whereby said spring limits the force that may be applied to said mechanism through said actuating means when said coin return means is disabled.

12. A coin totalizer for locking and unlocking a door on a vending machine, the door having a tongue engaged by said totalizer when the door is closed, comprising:

means for locking the vending machine door, said locking means comprising an extension member that engages the door tongue to prevent the door from opening;

means for receiving and identifying coins inserted into said mechanism;

means for holding coins from said receiving and identifying means;

means for accumulating the value of coins in said holding means;

means for unlocking the vending machine door when the value of coins in said holding means meets or exceeds a predetermined value, said unlocking means comprising a slidable latch member, said latch member having a lower surface capable of camming the door tongue past said extension member when said slidable latch member is held in a downward position, a latch restraint member, said latch restraint member being normally biased to a first position that holds said latch member in the downward position, means for moving said latch restraint member to a second position that does not hold said latch member in the downward position, and means for releasably securing said latch restraint member in said second position, said releasable securing means being normally biased to a position that secures said latch restraint member in said second position, whereby said releasable securing means releases said latch restraint member in response to a signal from said accumulating means, said latch restraint member holding said latch member in the downward position for camming the door tongue past said extension member;

means for returning coins collected in said holding means;

means for disabling said coin return means when the vending machine door is opened; and means for collecting coins from said holding means when the vending machine door is opened.

13. A coin totalizer according to claim 12, wherein said moving means moves said latch restraint member to said second position when the door to the vending machine is open or when said coin return means is actuated.

14. A coin totalizer according to claim 12, wherein:

said coin return means comprises means for moving said holding means to a coin return slot; and said means for disabling said coin return means comprises means for preventing said moving means from moving.

15. Apparatus for locking and unlocking a door on a vending machine in response to the receipt of a predetermined value of coins, the door having a spring-biased tongue for engagement by said apparatus, comprising:

means for locking the door tongue within said apparatus, said locking means including an extension member that engages the door tongue to prevent the door from opening when the door tongue is in a normally biased state;

means for unlocking the door tongue, comprising:

a slidable latch member, said latch member having a surface capable of camming the spring-biased door tongue out of its normally biased state and past said extension member when said slidable latch member is prevented from moving away from the door tongue, a latch restraint member, said latch restraint member being normally biased to a blocking position that prevents said slidable latch member from moving away from said door tongue, means for moving said latch restraint member to a nonblocking position that permits said latch member to move away from said door tongue, and means for releasably securing said latch restraint member in said nonblocking position, said releasable securing means being normally biased to a position that secures said latch restraint member in said nonblocking position, whereby said latch restraint member moves to said blocking position when released by said releasable securing means, preventing said latch member from moving away from the door tongue, causing said latch member to cam the door tongue in opposition to the spring bias past said extension member.

16. Apparatus according to claim 15, wherein said latch restraint member includes a chamfered edge, and further comprising, means for returning coins received in said apparatus; and a rotatable reset arm member having a chamfered edge and an extension, said reset arm being rotatable about a shaft on said apparatus, said extension being biased against the door tongue, the door tongue engaging said extension and causing said reset arm to rotate as the door tongue is withdrawn and reinserted within said apparatus, rotation of said reset arm member in response to withdrawal of the door tongue from said apparatus first disabling said coin return means and then causing said chamfered edge of said reset arm to engage said chamfered edge of said latch restraint member, moving said latch restraint member to the nonblocking position.

17. Apparatus according to claim 16, wherein said latch restraint member includes a second chamfered edge;

said reset arm member includes a second chamfered edge;

said second chamfered edge on said latch restraint member engaging said second chamfered edge on said reset arm member in response to actuation of said coin return means, moving said latch restraint member to said nonblocking position before any coins are returned by said coin return means.

18. A device for determining a dimensional characteristic of a disc-like object, said device comprising:

means defining an arcuate shoulder which the object traverses in response to the force due to gravity;

means for conducting said object against said arcuate shoulder, said conducting means comprising a body rotatable about a shaft, said body having a projection with an upper surface for engaging the object and conducting the object against said arcuate shoulder, and said projection being downwardly rotatable about said shaft in response to contact with the object to permit passage of the object between said projection and said arcuate shoulder;

means, adjacent said shoulder and positioned to be proximate the object at least part of a time interval over which the object traverses said shoulder, for sensing passage of the object and for producing a signal indicative of a timing of said passage; and means responsive to said sensing means for determining said dimensional characteristic on the basis of said signal.

19. A coin totalizer, comprising:

means for handling a coin, said handling means including an arcuate shoulder, said arcuate shoulder defining a path for the coin;

means forming a part of said handling means for conducting the coin against said arcuate shoulder, said conducting means including a body rotatable about a shaft, said body having a projection with an upper surface for engaging the coin, said projection extending into said coin path in position to conduct the coin against said arcuate shoulder, and said projection being downwardly rotatable about said shaft in response to contact with the coin to permit passage of the coin between said projection and said arcuate shoulder;

means for detecting the value of the coin traveling along said arcuate shoulder after the coin has been engaged by said conducting means; and means for holding the coin after it has passed said detecting means.

20. A coin totalizer, comprising:

means for handling a coin, said handling means including an arcuate shoulder, said arcuate shoulder defining a path for the coin;

means forming a part of said handling means for conducting the coin against said arcuate shoulder, said conducting means including a body rotatable about a shaft, said body having a projection with an upper surface for engaging the coin;

means for detecting the value of the coin traveling along said arcuate shoulder after the coin has been engaged by said conducting means;

means for holding the coin after it has passed said detecting means;

means for returning coins in said handling means, said coin return means including means for causing said rotatable body to rotate about said shaft;

means responsive to said coin value detecting means for accumulating the value of coins in said holding means and storing said value in an accumulator; and means for detecting motion of said rotatable body caused by said coin return means and resetting said value in said accumulator to zero, whereby actuation of said coin return means causes said value in said accumulator to be reset to zero.

21. A coin totalizer for locking and unlocking a door on a vending machine, the door having a tongue engaged by said totalizer when the door is closed, comprising:

means for locking the vending machine door;

means for receiving and identifying coins inserted into said mechanism;

means for holding coins from said receiving and identifying means, said holding means being normally positioned in a first position and being pivotable to a second position and having a single door on the lower end thereof;

means for accumulating the value of coins in said holding means;

means for unlocking the vending machine door when the value of coins in said holding means meets or exceeds a predetermined value;

means for returning coins collected in said holding means, said returning means causing said holding means to pivot from the first position to the second position thereof, opening the single door on said holding means to release coins collected therein;

means for disabling said coin return means when the vending machine door is opened, said disabling means preventing said holding means from pivoting from the first position to the second position thereof; and means for collecting coins from said holding means when the vending machine door is opened.

* * * * *